US006616135B1

(12) United States Patent
Shida et al.

(10) Patent No.: US 6,616,135 B1
(45) Date of Patent: Sep. 9, 2003

(54) BOOKBINDING APPARATUS USING PASTING PROCESS

(75) Inventors: Toshio Shida, Tokyo (JP); Hitoshi Tamura, Tokyo (JP); Tsuyoshi Tsuchiya, Tokyo (JP); Toshitaka Matsumoto, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/705,405

(22) Filed: Nov. 3, 2000

(30) Foreign Application Priority Data

Nov. 8, 1999 (JP) ..... 11-316959
Jan. 20, 2000 (JP) ..... 2000/011731

(51) Int. Cl.[7] ..... B42C 9/00; B65H 37/04

(52) U.S. Cl. ..... 270/58.08; 270/58.07; 412/8; 412/37; 399/407; 399/408; 156/364; 156/568

(58) Field of Search ..... 412/8, 37; 399/407, 399/408; 270/58.07, 58.08; 156/568, 364, 563, 566

(56) References Cited

U.S. PATENT DOCUMENTS 4,511,297 A * 4/1985 Wilson et al. ..... 412/8
4,537,650 A * 8/1985 Coons, Jr. ..... 156/384
4,540,458 A * 9/1985 Baughman et al. ..... 156/312
4,611,741 A * 9/1986 Wilson ..... 227/99
5,897,250 A * 4/1999 Hirai et al. ..... 399/404
5,905,935 A * 5/1999 Wakamatsu et al. ..... 399/407
6,042,672 A * 3/2000 Kishine et al. ..... 156/200
6,048,152 A * 4/2000 Koyama ..... 412/22

FOREIGN PATENT DOCUMENTS

JP 2000-16682 * 1/2000
JP 2000-318345 * 11/2000

* cited by examiner

*Primary Examiner*—Patrick Mackey
(74) *Attorney, Agent, or Firm*—Frishauf, Holtz, Goodman & Chick, P.C.

(57) ABSTRACT

A pasting binding apparatus for binding a bundle of sheets comprises a paste coating device to coat a paste in a form of a line onto a binding side of a sheet being conveyed on a conveying passage in a conveying direction by a conveying device; a pressing device located above the paste coating device and to stack the sheet coated with the paste onto the bundle of sheets and to press the sheet onto the bundle of sheets; and the conveying device to convey the sheet to the paste coating device and to the pressing device.

33 Claims, 20 Drawing Sheets

FIG. 18 ( a )
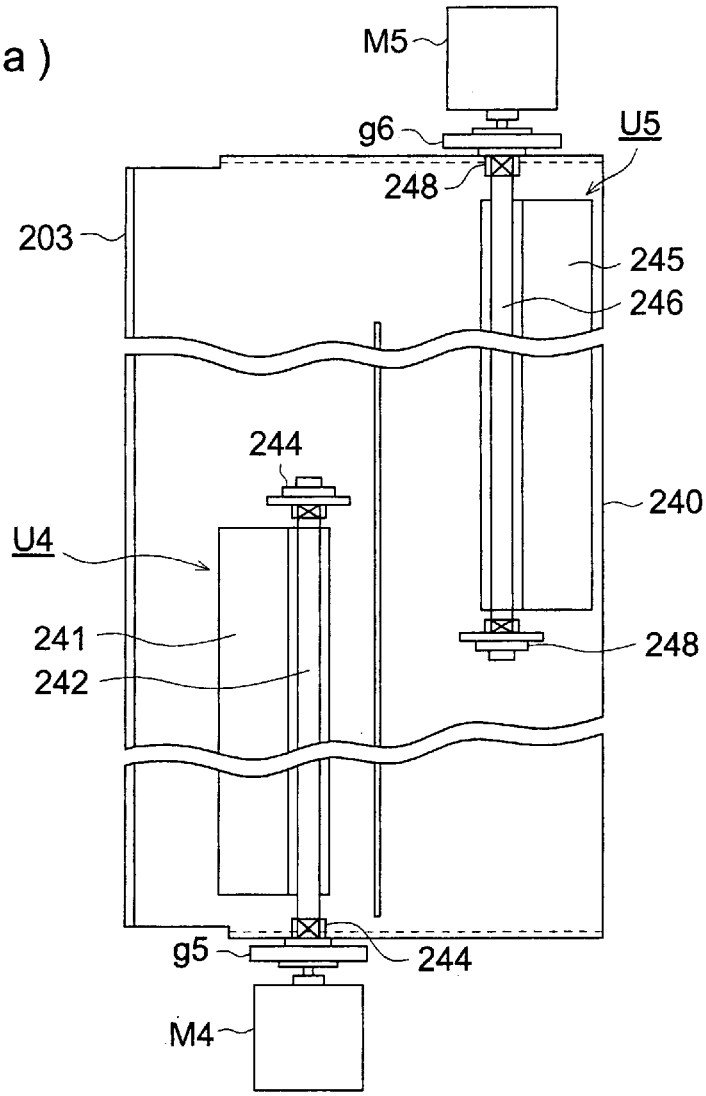
FIG. 18 ( b )
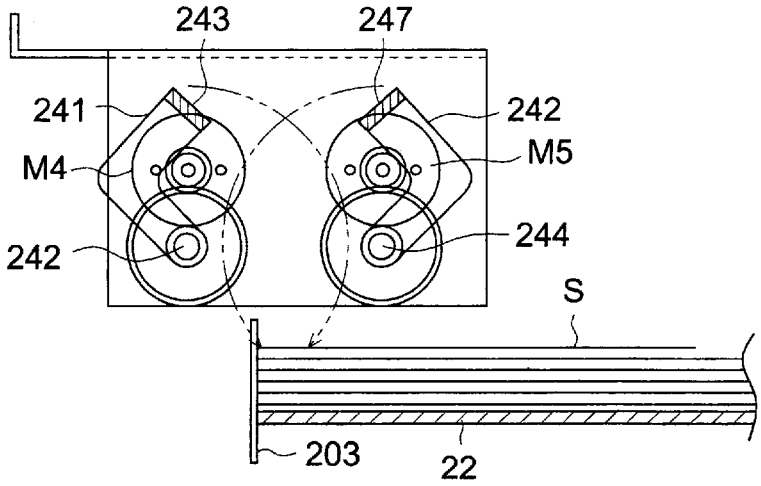

BOOKBINDING APPARATUS USING PASTING PROCESS

SUMMARY OF THE INVENTION

FIELD OF THE INVENTION

This invention relates to a bookbinding apparatus using a pasting process (hereinafter referred to as "pasting-binding apparatus" for simplicity's sake) which carries out bookbinding by coating with paste each of paper sheets which have been subjected to an image forming process and ejected from an image forming apparatus one after another on a belt-shaped portion in the neighborhood of one side edge during the transport of the sheet, and to an image forming apparatus provided with the pasting-binding apparatus.

In recent years, it has been provided a pasting-binding apparatus which makes bookbinding by carrying out a pasting process on a predetermined position of paper sheets which have an image formed by an image forming apparatus such as a copying machine, a printer, and a compound machine of these.

For an apparatus for carrying out the pasting process, (1) an apparatus which ejects paste to a paper sheet using a paste ejecting nozzle, (2) an apparatus which is composed of a paste containing box provided with a rolling paste wheel having paste put on the outer periphery and carrying out contact transfer of the paste by bringing the outer periphery of the paste wheel into contact with a paper sheet, (3) a hot-melt coating apparatus which ejects from a nozzle a mixed material composed of a hot-melt agent (a heat-fusing agent) and heated compressed air, and so forth have been used.

A bookbinding apparatus which is noted in the publication of TOKUHYOSHO 59-500907 carries out book binding by a process comprising the steps of deflecting a paper sheet being conveyed in a first direction to a second direction perpendicular to the first direction, and after that, coating the running paper sheet with paste on a line-shaped portion at the edge of it, and applying pressure after stacking and adjusting the sheet.

In the above-described pasting-binding apparatus, there are following problems:

(1) The portion for receiving bundles of paper sheets after pasting-binding becomes small, because the adjusting pressing means is disposed under the paste coating means.

(2) Since the pasting-binding apparatus is structured such that the sheet conveying direction is necessarily rotated by 90 degrees before the paste coating process, a binding direction of paper sheets can not be selected freely.

(3) The pasting-binding apparatus is made large-sized, by separately providing output paper trays for the bookbinding mode, and the other modes, for example, the shift paper ejection mode and the direct paper ejection mode which are different in the direction of paper ejection.

(4) The pasting-binding apparatus is made complex by the necessity of a paper ejection shifting function being separately provided.

(5) The pasting-binding for paper sheets subjected to a center-folding process or a Z-folding process can not be made.

(6) The direction of loading a cover sheet into the cover sheet feeding apparatus must be changed depending on the binding direction of the bundle of paper sheets.

(7) It is impossible to carry out pasting-binding after carrying out a folding process for a cover sheet.

(8) The sizes of the width and the depth of the pasting-binding apparatus are made larger because the means for converting the paper sheet direction and the means for coating paste are located approximately on the same plane.

(9) Because the paste-coated area is pressed by a pressing means after receiving and adjusting paper sheets in the paper accommodating section in a conventional pasting pressing means, the adjusting operation time is shortened in order to make the book binding process speed correspond to the transport speed of papers ejected from the image forming apparatus; therefore, accuracy of adjusting is lowered, and the produced quality of book binding is lowered.

(10) In a conventional pasting pressing means, book binding is made by pressure-bonding the paper sheets through applying pressure to the trailing edge of the topmost sheet simultaneously over the whole area of the line-shaped paste-coated portion formed on each of the sheets with a single pressing bar assembly having a shape of a bar; therefore, the pressing load is large, and a driving means having a large output is necessary.

(11) In a conventional pasting pressing means, uniform pressure can not be applied to the trailing edge of the line-shaped paste-coated area formed on the paper sheets, therefore the paste film thickness in the paste-coated area is easy to become uneven, and the produced quality of bookbinding is lowered.

It is an object of this invention, by solving the above-described problems, to improve the paste supplying means and the paste ejecting means of a pasting-binding apparatus, to accomplish the improvement of the produced quality of bookbinding of bundles of paper sheets having been subjected to an image forming process, to actualize making an apparatus small-sized and simplified, and to provide a pasting-binding apparatus having an excellent operational performance and an image forming apparatus provided with the pasting-binding apparatus.

The above object can be attained by the following structures.

90 degrees on a plane parallel to the conveying passage in accordance with the binding side of the sheet;

a pressing device to stack the sheet coated with the paste onto the bundle of sheets and to press the sheet onto the bundle of sheets; and the conveying device to convey the sheet to the rotating device, to the paste coating device and to the pressing device.

90 degrees on a plane parallel to the conveying passage in accordance with the binding side of the sheet;

a pressing device to stack the sheet coated with the paste onto the bundle of sheets and to press the sheet onto the bundle of sheets; and the conveying device to convey the sheet to the rotating device, to the paste coating device and to the pressing device.

Further, the above object may be attained by the following preferable structures.

(1) A pasting-binding apparatus of this invention to solve the above-described problems is one comprising a sheet rotating means (a rotating device) for holding a paper sheet and rotating it by 90 degrees against the conveying direction in the horizontal plane, a paste coating means (a paste coating device) for coating it with paste the paper sheet conveyed by a conveying means (a conveying device) on the line-shaped portion at the edge of the sheet, an adjusting-pressing means (a pressing device) for pressing the paper sheets having been coated with paste after stacking and adjusting them, and a paper sheet bundle stacking means (a sheet bundle stacking device) for ejecting and stacking the paper sheet bundles by pressing after adjusting, wherein said sheet rotating means is disposed at the upstream side of said paste coating means in the paper conveying direction.

(2) A pasting pressing method of a bookbinding apparatus of this invention comprises the steps of coating with paste each of paper sheets conveyed on the straight-line-shaped or broken-line-shaped portion in the neighborhood of one side edge by a paste coating means, stacking the plural paper sheets having been coated with paste in a paper sheet receiving unit successively with one sheet on another, and pressing the trailing edge of the paste-coated portion of said plural paper sheets having been adjusted by an adjusting means in said paper sheet receiving unit for every one sheet or for every certain plural number of sheets by a pressing means.

(3) A bookbinding apparatus of this invention comprises a paste coating means for coating with paste each of paper sheets conveyed by a conveying means on the line-shaped potion in the neighborhood of one side edge, a paper sheet receiving unit for receiving a plurality of paper sheets having been coated with paste to be placed one upon another, an adjusting means for adjusting said paper sheets received in said paper sheet receiving unit to a basic position, a pasting pressing means for pressing the trailing edge of the paste-coated portion of the paper sheets every time when one sheet or certain plural number of sheets are stacked in said paper sheet receiving unit, and a drive means for driving said pasting pressing means.

(4) A bookbinding apparatus of this invention comprises a paste coating means disposed at a fixed position for coating each of paper sheets conveyed by a conveying means with paste on the line-shaped potion in the neighborhood of one side edge during the transport of the paper sheets, a paper sheet receiving unit for receiving a plurality of paper sheets having been coated with paste to be placed one upon another, a stopper means for truing up the leading edges of the sheets by bringing the leading edge portion of the paper sheets received in said paper sheet receiving unit into contact with it, an adjusting means for adjusting the paper sheets by bringing the paper sheets into contact with its one side which is parallel to the paper conveying direction, a pasting pressing means composed of a pressing member capable of revolving which moves while pressing the trailing edge of the paste-coated portion of the paper sheets every time when one sheet or certain plural number of sheets of said paper sheets to be received in said paper sheet receiving unit are stacked, and a drive means for driving said pasting pressing means.

(5) A bookbinding apparatus of this invention comprises a paste coating means disposed at a fixed position for coating each of paper sheets conveyed by a conveying means with paste on the line-shaped potion in the neighborhood of one side edge during the transport of the paper sheets, a paper sheet receiving unit for receiving a plurality of paper sheets having been coated with paste to be placed one upon another, a stopper means for truing up the leading edges of the sheets by bringing the leading edge portion of the paper sheets received in said paper sheet receiving unit into contact with it, an adjusting means for adjusting the paper sheets by bringing the paper sheets into contact with its one side which is parallel to the paper conveying direction, a pasting pressing means composed of a pressing member which is supported in such a manner as to be able to move back and forth in the direction parallel to the paper conveying direction and has a cylindrical surface capable of oscillating, and a drive means for making said pasting pressing means do the back and forth moving and oscillating action.

(6) A bookbinding apparatus of this invention comprises a paste coating means disposed at a fixed position for coating each of paper sheets conveyed by a conveying means with paste on the line-shaped potion in the neighborhood of one side edge during the transport of the paper sheets, a paper sheet receiving unit for receiving a plurality of paper sheets having been coated with paste to be placed one upon another, a stopper means for truing up the leading edges of the sheets by bringing the leading edge portion of the paper sheets received in said paper sheet receiving unit into contact with it, an adjusting means for adjusting the paper sheets by bringing the paper sheets into contact with its one side which is parallel to the paper conveying direction, a pasting pressing means composed of a pressing member (a pressing head) capable of moving up and down for pressing the trailing edge of the paste-coated portion of the paper sheets, and a drive means for driving said pasting pressing means.

(7) A bookbinding apparatus of this invention comprises a paste coating means disposed at a fixed position for coating each of paper sheets conveyed by a conveying means with paste on the line-shaped potion in the neighborhood of one side edge during the transport of the paper sheets, a paper sheet receiving unit for receiving a plurality of paper sheets having been coated with paste to be placed one upon another, a stopper means for truing up the leading edges of the sheets by bringing the leading edge portion of the paper sheets received in said paper sheet receiving unit into contact with it, an adjusting means for adjusting the paper sheets by bringing the paper sheets into contact with its one side which is parallel to the paper conveying direction, plural sets of pasting pressing means composed of a pressing member capable of moving up and down for pressing the trailing edge of the paste-coated portion of the paper sheets and a drive means, wherein said plural sets of pasting pressing means are capable of operating independently of one another, and are disposed in a manner such that the areas to be pressed by the pressing member of said plural sets of pasting pressing means overlaps partly one another, and each of the neighboring pressing members are made to operate alternately.

(8) An image forming apparatus of this invention has it connected, a bookbinding apparatus which is provided with a pasting pressing means as set forth in any one of the above-described paragraphs (3) to (7), and said bookbinding apparatus receives the paper sheets ejected from the image forming apparatus and carries out a pasting-binding process.

BRIEF DESCRIPTION OF THE DRAWINGS

FIG. 4(*a*) a drawing showing the formation of a paste-coated portion at the longer side of a paper sheet, FIG. 4(*b*) a drawing showing the formation of a paste-coated portion at the shorter side of a paper sheet, FIG. 4(*c*) a drawing showing the formation of a paste-coated portion on a paper sheet subjected to a center-folding process, FIG. 4(*d*) a drawing showing the formation of a paste-coated portion on a paper subjected to a Z-folding process;

FIGS. 18(*a*) and 18(*b*) are the plan and the front view showing a pasting pressing means in the inactivated state;

DETAILED DESCRIPTION OF THE PREFERRED EMBODIMENT

In the following, a pasting-binding apparatus and an image forming apparatus provided with a pasting-binding apparatus of this invention will be explained with reference to the drawings.

Figure 1:
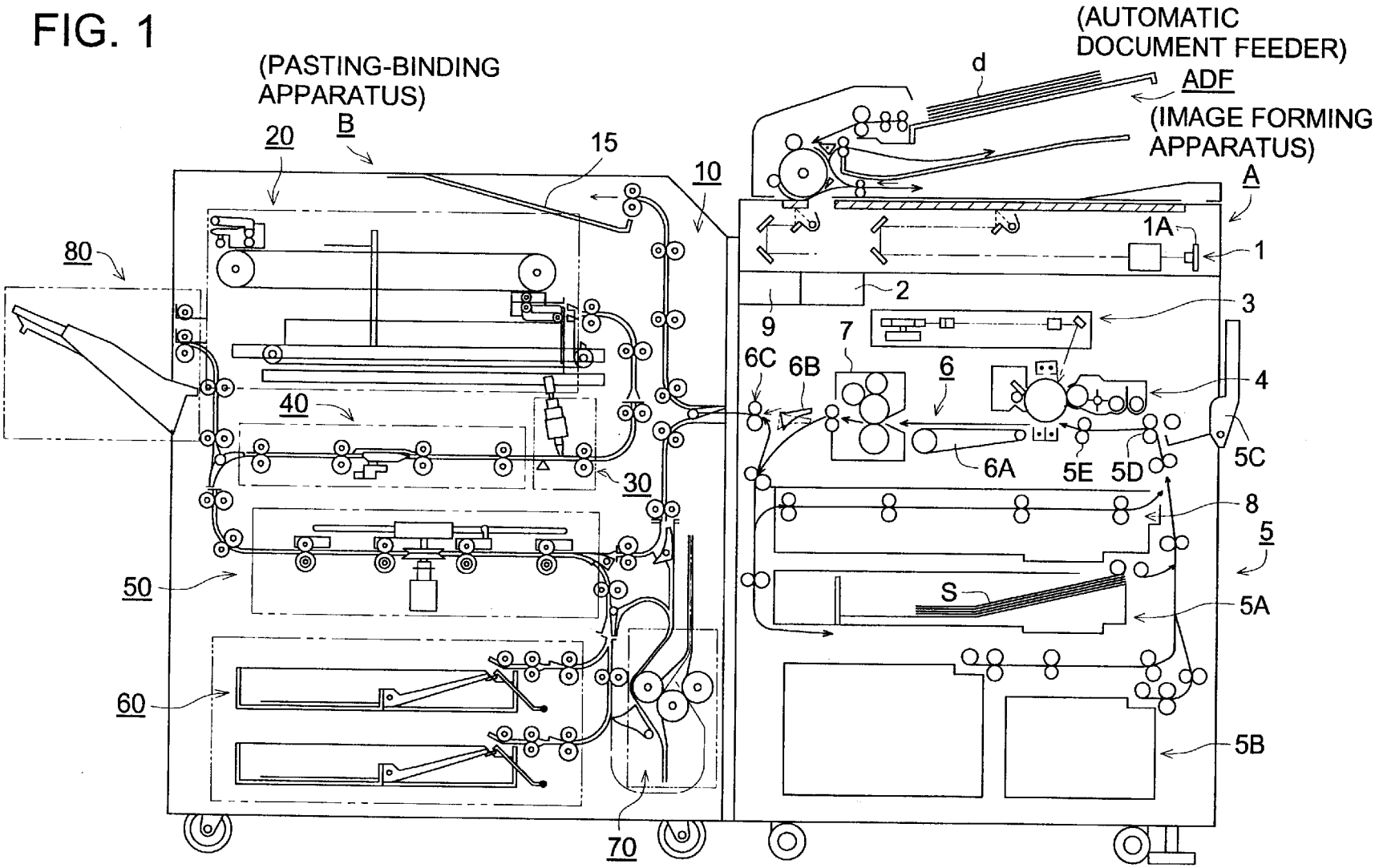
FIG. 1 is a drawing showing the overall structure of an image forming system composed of an image forming apparatus, an automatic document feeder, and a pasting-binding apparatus.

FIG. 1 is a drawing showing the overall structure of an image forming system composed of the image forming apparatus A, the automatic document feeder ADF, and the pasting-binding apparatus B.

The image forming apparatus A is equipped with the image reading means 1, the image processing means 2, the image writing means 3, the image forming means 4, the paper feeding means 5, the conveying means 6, the fixing means 7, the re-conveying means (the automatic duplex copying transport unit ADU) 8, the control means 9, etc.

The paper feeding means 5 is composed of the cassette paper feeding unit 5A, the large capacity paper feeding unit (LCT) 5B, the manual feeding unit 5C, the intermediate feed rollers 5D, and the registration rollers 5E.

The conveying means 6 is equipped with the transport belt 6A, the conveying passage switching plate 6B, the ejection rollers 6C, etc.

The automatic document feeder ADF is provided on the upper side of the image forming apparatus A. At the left side in the drawing, the side of the ejection rollers 6C, of the image forming apparatus A, the pasting-binding apparatus B is coupled.

The document d, which is placed on the document base of the automatic document feeder ADF, is conveyed in the direction of the arrow marks, and the image on the one side or both sides of the document is read by the optical system of the image reading means 1, and further, read by the CCD image sensor 1A.

The analogue signal, which has been obtained by the photoelectric conversion of the CCD image sensor 1A, is transmitted to the image writing means 3 after being subjected to analogue processing, A/D conversion, shading correction, image compression processing, etc.

In the image writing means 3, the output beam from the semiconductor laser is applied to the photoreceptor drum of the image forming means 4, to form a latent image. In the image forming means 4, such processes as charging, exposure, development, transfer, detachment, cleaning are carried out. Onto the paper sheet S, which has been conveyed out from the paper feeding means 5, the image is transferred in the transfer unit.

The paper sheet S carrying the image is conveyed by the transport belt 6A, has its image fixed by the fixing means 7, and conveyed from the ejection rollers 6C into the receiving portion 11 of the pasting-binding apparatus B. In other way, the paper sheet S, which has been subjected to the image forming process for the image on one side and conveyed into the re-conveying means 8 by the conveying passage switching plate 6B, is ejected from the ejection rollers 6C after being again subjected to the image forming process in the image forming means 4 for the image on the other side. The paper sheet S ejected from the ejection rollers 6C is conveyed into the receiving portion 11 of the pasting-binding apparatus B.

In the pasting-binding apparatus B, from the top of the drawing shown, the fixed output tray 15, the adjusting-pressing means 20, the paste coating means 30, the skew-deviation correcting means 40, the sheet rotating means 50, and the cover sheet feeding means 60 are disposed in a perpendicular arrangement in the approximately vertical direction.

In the right side part of the pasting-binding apparatus B shown in the drawing, the entrance conveying means 10 and the folding means 70 are disposed. At the left side of the book pasting-binding apparatus B shown in the drawing, the paper sheet bundle stacking means 80 for stacking the paste-processed bound book is disposed.

Figure 2:
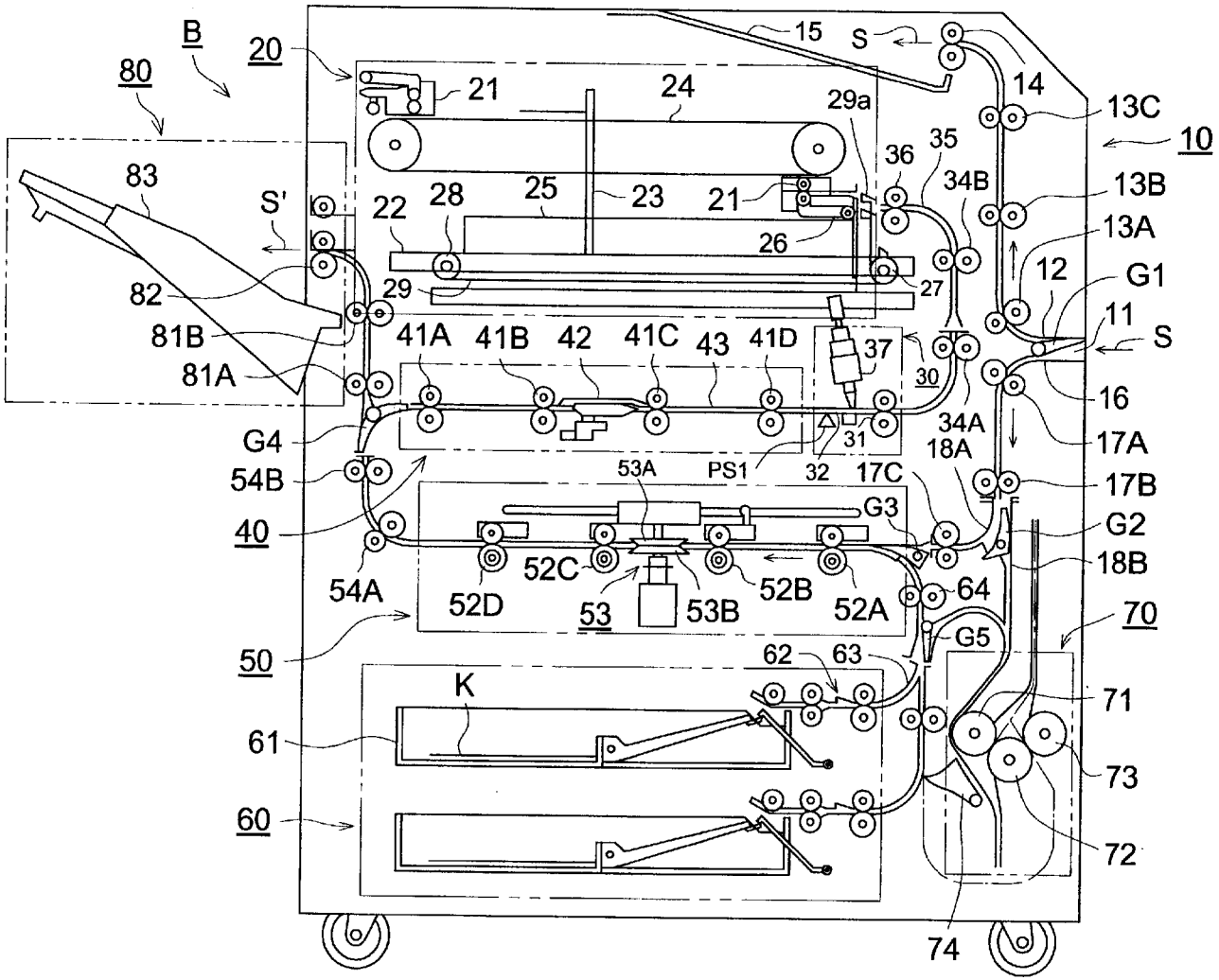
FIG. 2 is a drawing showing the structure of the paper conveying passage of a pasting-binding apparatus.
Figure 3:
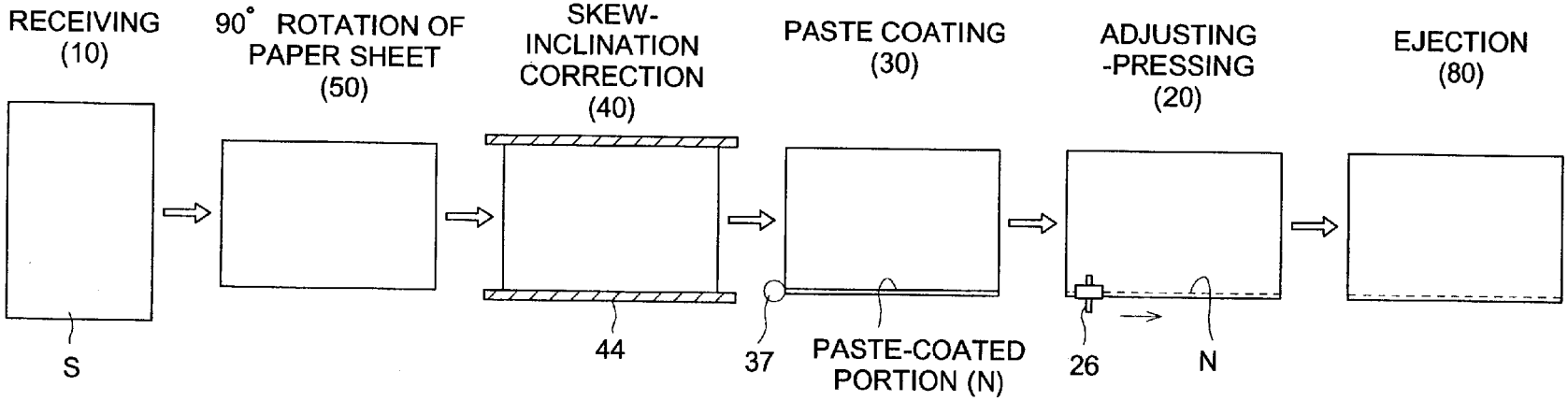
FIG. 3 is a schematic drawing showing the process of pasting-binding for paper sheets.

FIG. 2 is a drawing showing the structure of the paper conveying passage in the pasting-binding apparatus B. FIG. 3 is a schematic drawing showing the process of pasting-binding for paper sheets.

The pasting-binding apparatus B is mounted through an adjustment of the position and height such that the receiving portion 11 of the entrance conveying means 10 comes to a position corresponding to the ejection rollers 6C of the image forming apparatus A.

The conveying passage for the paper sheet S connected to the receiving portion 11 is bifurcated into the upper paper conveying passage 12 for the fixed output tray 15 in the uppermost part and the lower conveying passage 16, and by the selection of the angle of the switching gate G1, the paper sheet S is fed to either one or the other of the above-mentioned conveying passages.

The upper conveying passage 12 is composed of the conveying rollers 13A, 13B, and 13C, the ejection rollers 14, the guide plates, etc. The lower conveying passage 16 is composed of the conveying rollers 17A, 17B, and 17C, the switching gate G2, the guide plates, etc.

The paper conveying passage connected to the lower conveying passage 16 is bifurcated into the two pathways, one of which leads to the sheet rotating means 50 in the middle part and the other leads to the folding means 70 in the lowermost part, and by the selection of the angle of the switching gate G2, the paper sheet S is fed to either one or the other of the above-mentioned pathways.

(1) DIRECT EJECTION ONTO THE FIXED OUTPUT TRAY 15 AT THE TOP OF THE APPARATUS

The paper sheet S, which has been subjected to image formation and ejected from the image forming apparatus A, is introduced in the receiving portion 11, passes the paper conveying passage 12, is conveyed by the conveying rollers 13A, 13B, and 13C and the guide plates, is gripped between the ejection rollers 14, and is ejected onto the fixed output tray 15 at the upper outside of the apparatus, to be placed on other sheets successively.

In this process of paper transport, the switching gate G1 is oscillated by the driving of a solenoid, to make it possible for the paper sheet S to pass toward the fixed output tray 15 by closing the paper conveying passage 16 and bringing the paper conveying passage 12 into the open state.

(2) 90 DEGREES+ ROTATION PROCESSING OF A PAPER SHEET

If the apparatus is set in this sheet rotating mode, the switching gate G2 is in the state of solenoid being off, closes the paper transport 18B, keeps the paper conveying passage 18A in the open state, and makes it possible for the paper sheet S to pass the paper conveying passage 18A.

The paper sheet S, which has been subjected to image forming and is ejected from the image forming apparatus A, passes the receiving portion 11, the paper conveying passage 16, the conveying rollers 17A and 17B, and the paper conveying passage 18A, which has been brought into the open state by the switching gate G2, is deflected to the left in the approximately perpendicular direction shown in the drawing, is gripped between the conveying rollers 17C, and is fed into the sheet rotating means 50.

The paper sheet S, which has been introduced in the sheet rotating means 50, passes the paper conveying passage 51 which is opened by the switching gate G3 over it, and progresses between the guide plates to the direction of the arrow mark shown in the drawing, while being gripped between the conveying rollers 52A, 52B, 52C, and 52D.

When the central portion of the paper sheet S reaches the rotating member 53, the paper transport is stopped for a while, and the conveying rollers 52A, 52B, 52C, and 52D is released from being pressed, to be kept in the off state. In this state of the conveying rollers 52A, 52B, 52C, and 52D released from being pressed, by the rotation of the upper and lower rotary disks 53A and 53B of the rotating member 53 with the paper sheet S gripped between them, the direction of the paper sheet S is deflected by 90 degrees. For example, the paper sheet S of A4 size is converted into the orientation A4R by the rotating member 53.

The sheet rotating means 50 is capable of practicing the 90 degrees' rotation of the paper sheet S and the processing for bringing the paper sheet S to one side at the same time, or it is capable of practicing the 90 degrees' rotation of the paper sheet S and the processing for bringing the paper sheet S to one side separately.

The paper sheet S, which has been rotated in its orientation, is conveyed by the pressing and rotation of the conveying rollers 52A, 52B, 52C, and 52D, is conveyed out from the sheet rotating means 50, is guided by the conveying rollers 54A and 54B and the guide plates, to be deflected to the upward vertical direction shown in the drawing, is further deflected to the right direction shown in the drawing after passing the switching gate G4, and is fed into the skew-deviation correcting means 40.

The paper sheet S, which does not need to be subjected to the pasting-binding process, passes the paper conveying passage at the left side of the switching gate G4 by the driving of a solenoid, is conveyed by the conveying rollers 81A and 81B and the guide plates, and is ejected to the up-and-down moving output tray 83 outside the apparatus by the ejection rollers 82.

(3) SKEW-DEVIATION CORRECTING PROCESS

The skew-deviation correcting means 40 is composed of the conveying roller pairs 41A, 41B, 41C, and 41D, each pair of which is capable of gripping the paper sheet S between the rollers and releasing it from being gripped, the width adjusting means 42, and the paper conveying passage 43, and lets the paper sheet S before the paste coating process come to one side to be trued up by bringing it into contact with the basic plate 44.

(4) PASTE COATING PROCESS FOR THE PAPER SHEET S

The paper sheet S, which has been fed into the paste coating means 30 from the skew-deviation correcting means 40, is gripped between the conveying rollers 31, and progresses in the right direction as shown by the arrow mark in the drawing. The paper conveying means 32 in the paste coating means 30 and the paper conveying passage 43 in the skew-deviation correcting means 40 are both formed approximately parallel to the paper conveying passage 51 in the sheet rotating means 50, and the conveying direction of the paper sheet S is reverse to it.

The paste ejecting means 37 receives the paste supplied from the bag-shaped container to be described later, and forms the paste-coated portion N by ejecting paste onto the belt-shaped or broken-line-shaped portion at one side edge of the running paper sheet S.

The paper sheet S, which has been subjected to the paste coating process, moves upward along the paper conveying passage composed of the conveying rollers 34A and 34B and the guide plates, and is gripped between the ejection rollers 36, to be ejected into the adjusting-pressing means 20.

(5) ADJUSTING-PRESSING PROCESS

The first paper sheet S, which has not been subjected to the paste coating process, is gripped between the gripper means 21, and is brought into contact with the stopper 23 at its leading edge, to be placed at a predetermined position on the stacker 22. The gripper means 21 is supported by the revolving belt 24 to move.

In the same way, the paper sheets S on and after the second one are gripped between the gripper means 21, and are stacked successively on the preceding paper sheet S on the stacker 22 with their paste-coated portion made to be on the downside. 25 denotes a pair of width adjusting members which is capable of moving in the width direction and regulate the position in the width direction of the paper sheets S.

The pressing roller member 26 is supported by the revolving belt 24 to move together with the gripper means 21. The pressing roller member 26 moves while pressing the trailing edge of the paste-coated portion of the paper sheet S, to secure the bonding between the paper sheets. Accordingly, since the gripper means 21 shifts while gripping the following sheet, a pasted reverse side of the preceding sheet having already been stacked on the stacker 22 is pressed by the pressing roller member 26 so that the preceding sheet is surely bound while the following sheet is conveyed onto the stacker 22. With this control, the time needed for the pressing work can be shortened.

The pressing process by the pressing roller member 26 may be carried out every time when the paper sheet S is placed on the stacker 22, or may be done every time when a certain plural number of paper sheets S have been stacked.

(6) STACKING BUNDLES OF PAPER SHEETS

In a part of the sheet stacking base of the stacker 22, a plurality of ejection belts, which are entrained around the drive roller 27 and the driven roller 28, are disposed in a manner capable of revolving.

When the last paper sheet S has been placed on the stacker 22 and subjected to the pressing process, to complete pasting-binding, the paste-bound bundle of paper sheets glides on the stacking base of the stacker 22, with its trailing edge portion held by the ejection fingers 29*a* of the ejection belt 29, is gripped between the ejection rollers 82, and is ejected onto the up-and-down moving output tray 83 of the paper bundle stacking means 80, to be placed on it.

On the up-and-down moving output tray 83, it is possible to stack the bundles of paper sheets which have been subjected to the pasting-binding process, and the paper sheets S which have not been subjected to the paste coating process, and paper sheets can be received by up-and-down driving.

(7) COVER SHEET FEEDING

The cover sheet feeding means 60 is composed of the paper feeding cassette 61 and the paper feeding member 62. The one cover sheet K fed from the paper feeding cassette 61 passes the paper feeding path 63, the conveying rollers 64, is conveyed into the sheet rotating means 50, passes through the skew-deviation correcting means 40, is paste-coated in the paste coating means 30, and in the adjusting-pressing means 20, is superposed on or under the above-described paper bundle, to be paste-bound.

Further, it is also possible that the one cover sheet K fed from the paper feeding cassette 61 passes through the paper feeding path 63, changes pathways at the switching gate G5, is fed into the folding means 70 to be described later, to be folded in two; then, it passes the conveying rollers 64, is fed into the sheet rotating means 50, passing through the skew-deviation correcting means 40, the paste coating means 30, and the adjusting-pressing means 20, and is superposed on the paper sheet bundle to be paste-bound.

(8) FOLDING PROCESS

The paper sheet S, which has been conveyed from the paper conveying passage 16 to the downward direction shown in the drawing, changes pathways at the switching gate G2, and is conveyed into the folding means 70 through the paper conveying passage 18B. The folding means 70 is composed of the folding rollers 71, 72, and 73, and carries out two-folding, or Z-folding for the paper sheet S conveyed in. The fold-processed paper sheet S comes back to the cover sheet feeding pathway, and passing through the conveying rollers 64 and the switching gate G2, is fed into the sheet rotating means 50; and further, passing through the skew-deviation correcting means 40, the paste coating means 30, and the adjusting-pressing means 20, it is pasted and bound.

Figure 4:
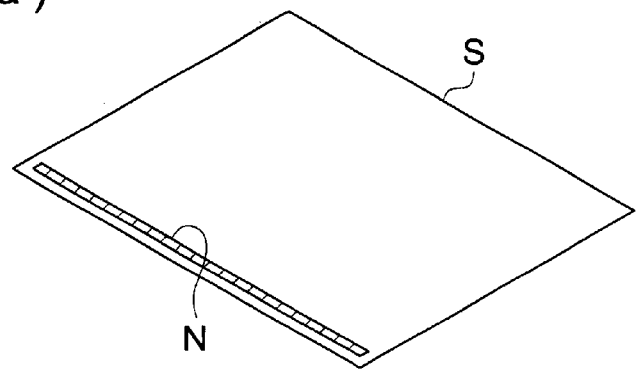
FIGS. 4(*a*) to 4(*d*) are perspective views showing the position of paste coating on various kinds of paper sheets.
Figure 4:
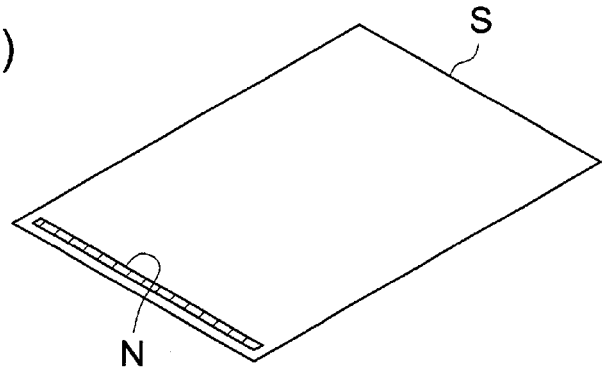
Figure 4:
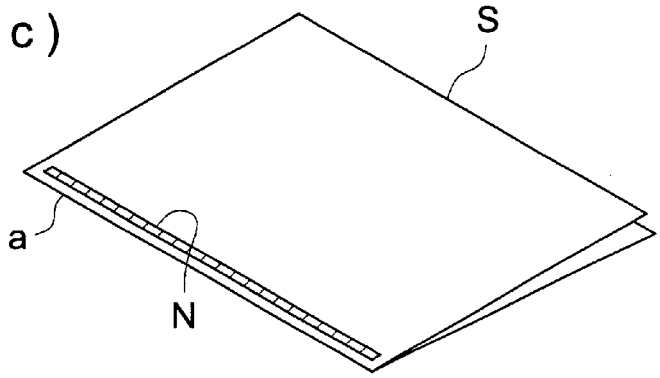
Figure 4:
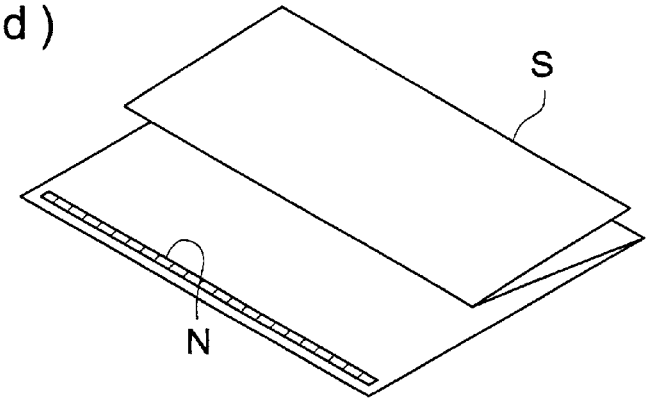

FIG. 4 are perspective views showing the paste coating position on the various kinds of paper sheets S: FIG. 4(*a*) is a drawing showing the formation of the paste-coated portion N at the longer side of the paper sheet S, FIG. 4(*b*) is a drawing showing the formation of the paste-coated portion N at the shorter side of the paper sheet S, FIG. 4(*c*) is a drawing showing the formation of the paste-coated portion N on the paper sheet S subjected to a two-folding process, and FIG. 4(*d*) is a drawing showing the formation of the paste-coated portion N on the paper sheet S subjected to a Z-folding process.

Figure 5:
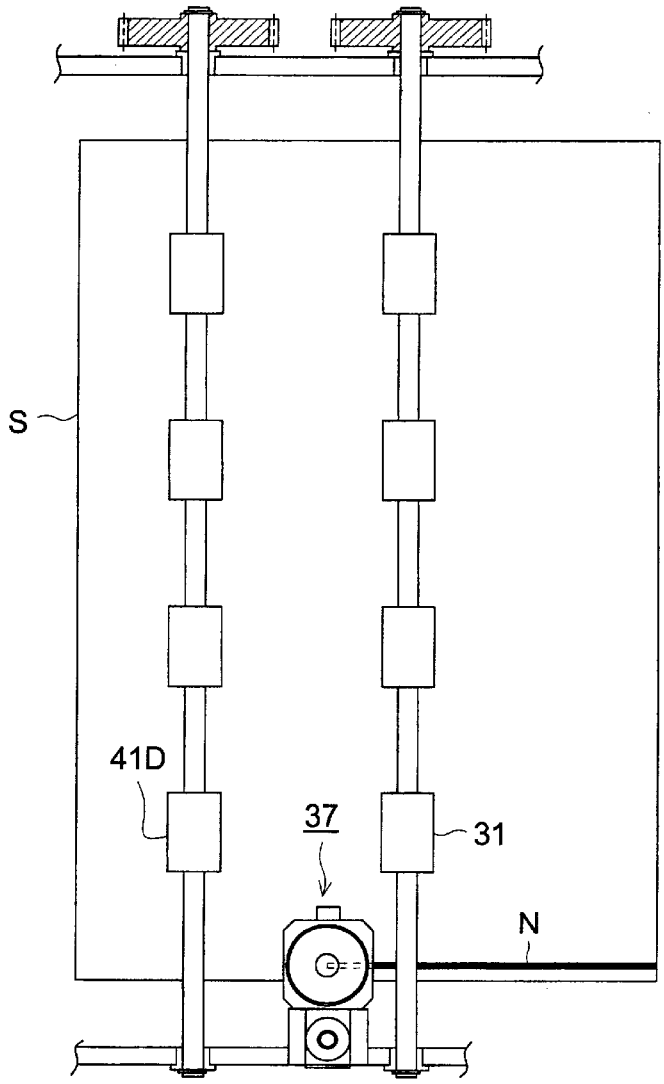
FIGS. 5(*a*) and 5(*b*) are a partial plan of a paste coating means and a partial front view of a paste coating means.
Figure 5:
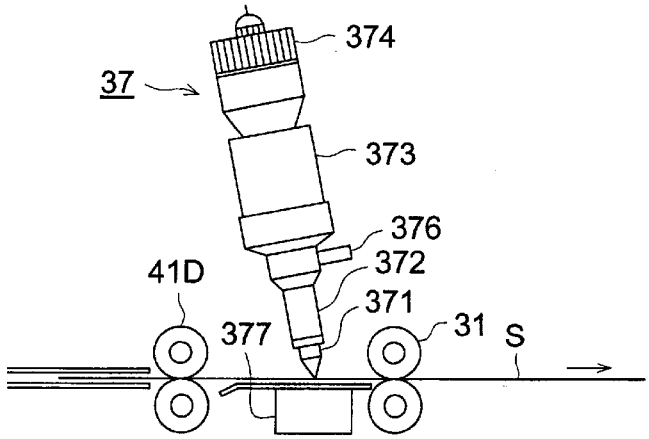
Figure 6:
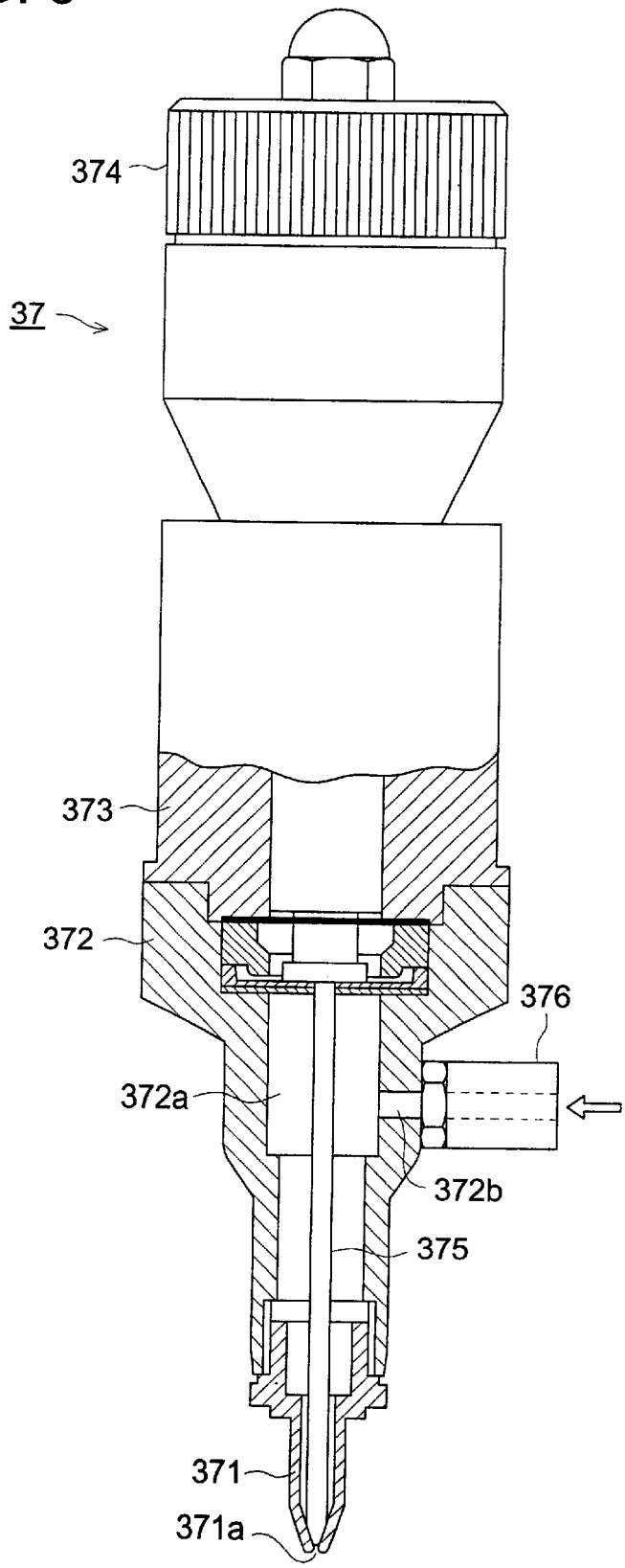
FIG. 6 is a cross-sectional view of a paste ejecting means.

FIG. 5(*a*) is the plan showing the portion in the neighborhood of the paste ejecting means of the paste coating means 30, FIG. 5(*b*) is the front view showing the portion in the neighborhood of the paste ejection means of the paste coating means 30, and FIG. 6 is a cross-sectional view of the paste ejecting means 37.

The paste ejecting means 37 is fixedly disposed at a predetermined position in the neighborhood of the side edge in the width direction of the paper sheet S between the conveying rollers 41D and 31. The paste ejecting means 37 is composed of the nozzle member 371, the supplying member 372, the electromagnetic valve 373, the adjusting member 374, the needle member 375, and the inlet member 376.

The inner diameter portion at the front end of the nozzle member 371 forms a cone shape being thinner toward the end, and the endmost portion is formed to make an opening 371*a* with a small diameter.

In the inner diameter portion of the nozzle member 371, the thin long needle member 375 is inserted in a movable manner. The end portion of the needle member 375 is formed to be thinner toward the end, to make it possible to open and close the opening 371*a* having a small diameter at the endmost portion of the nozzle member 371.

The rear end portion of the nozzle member 371 forms a screw to be fitted to the supplying member 372 to make an integral member. The inside of the supplying member 372 is formed to make the hollow-shaped pressure room 372*a*, and filled with paste for bonding paper sheets.

On the peripheral surface of the supplying member 372, introduction opening 372 is opened, and is coupled to inlet member 376. The paste for bonding paper sheets received in the bag-shaped container 38 to be described later is fed by pressure by the pressing means 39 to be described later, and passing through the supplying tube, the inlet member 376, and the introduction opening 372*b*, is supplied into the pressure room 372*a* of the supplying member 372.

The paste received in the pressure room 372*a* is ejected from the opening 371*a* of the nozzle member 371, by the needle member 375 being pushed forth by the action of the electromagnetic valve 373.

Further, the back-and-forth driving of the needle member 375 for preventing the solidification of the paste at the opening 371*a* of the nozzle member 371 is carried out before the start of the pasting to the paper sheet S, and the solidified paste and the paste ejected at that time are collected in the collecting container 377 located under the nozzle.

Moreover, the number of times of the back-and-forth driving of the needle member 375 and the length of the stroke in the back-and-forth moving for preventing the solidification of the paste are determined so as to make an optimum condition depending on the dimensions of the front end portion of the nozzle member 371 and the front end portion of the needle member 375 and the properties of the paste.

The paste used in the embodiment of this invention is an adhesive based on water soluble vinyl acetate, and its viscosity is 750–1500 cps at ordinary temperatures.

Figure 7:
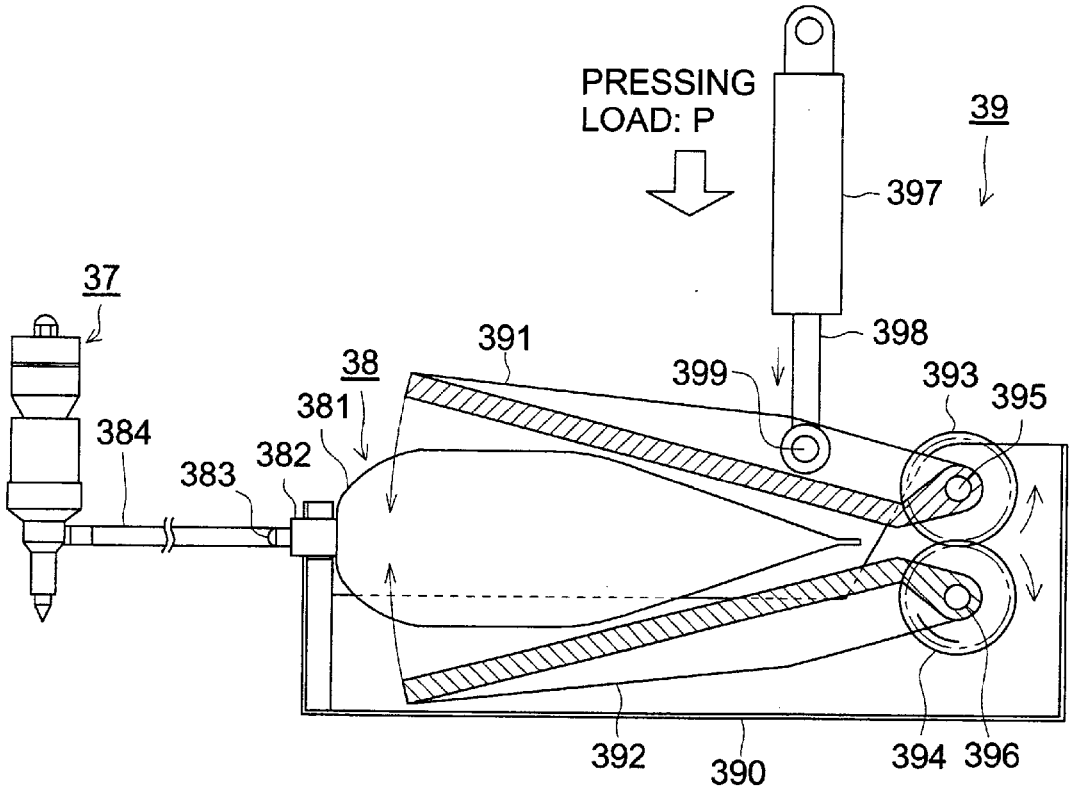
FIG. 7 is a cross-sectional view of a paste supplying means composed of a bag-shaped container and a pressing means.

FIG. 7 is a cross-sectional view of the paste supplying means composed of the bag-shaped container 38 for receiving paste and the pressing means 39 for enabling the ejection of the paste contained by pressing the bag-shaped container 38.

The bag-shaped container 38 for receiving paste is composed of the flexible bag member 381, the metal cap member 382 having an ejection opening, and the opening-and-closing valve 383. The opening-and-closing valve 383 is connected to the inlet member 376 of the ejecting means 37 through the supplying tube 384.

The bag-shaped container 38 is mounted at a predetermined position of the housing 390 of the pressing member 39 in a exchangeable manner.

The pressing means 39 is composed of one set of the pressing members 391 and 392, which are disposed in a V-shaped arrangement and have a symmetric shape, one set of the gears 393 and 394 engaging with each other, and the pressure applying member 397 which is connected to the pressing member 391 for applying pressure.

The base portion of the pressing member 391 and the central rotary shaft 395 of the gear 393 is formed integrally and supported in a rotatable manner by the side wall of the housing 390. The base portion of the pressing member 392 and the central rotary shaft 396 of the gear 394 is formed integrally and supported in a rotatable manner by the side wall of the housing 390.

The pressure applying member 397 is composed of an air pressure device such as a gas spring, and the end portion of the back-and-forth moving arm 398 is connected to the pressing member 391 through the joint 399. By the pressing load P of the pressure applying member 397, the arm 398 presses the pressing member 391. The pressing member 391 is oscillated around the rotary shaft 395 in the direction of the arrow mark shown in the drawing.

By the oscillation of the pressing member 391, the gear 393, which is formed integrally with the pressing member 391, rotates the gear 394 engaging with it. By the rotation of the gear 394, the pressing member 392 is oscillated around the rotary shaft 396 in the direction of the arrow mark shown in the drawing.

By the oscillation of the V-shaped pressing members 391 and 392, the flexible bag member 381 of the bag-shaped container 38 is compressed from the upside and downside directions, and the paste contained inside is ejected from the opening-and-closing valve 383, through the ejection opening of the metal cap member 382, to be supplied into the pressure room 372*a* of the paste ejection means 37 through the supplying tube 384.

Figure 8:
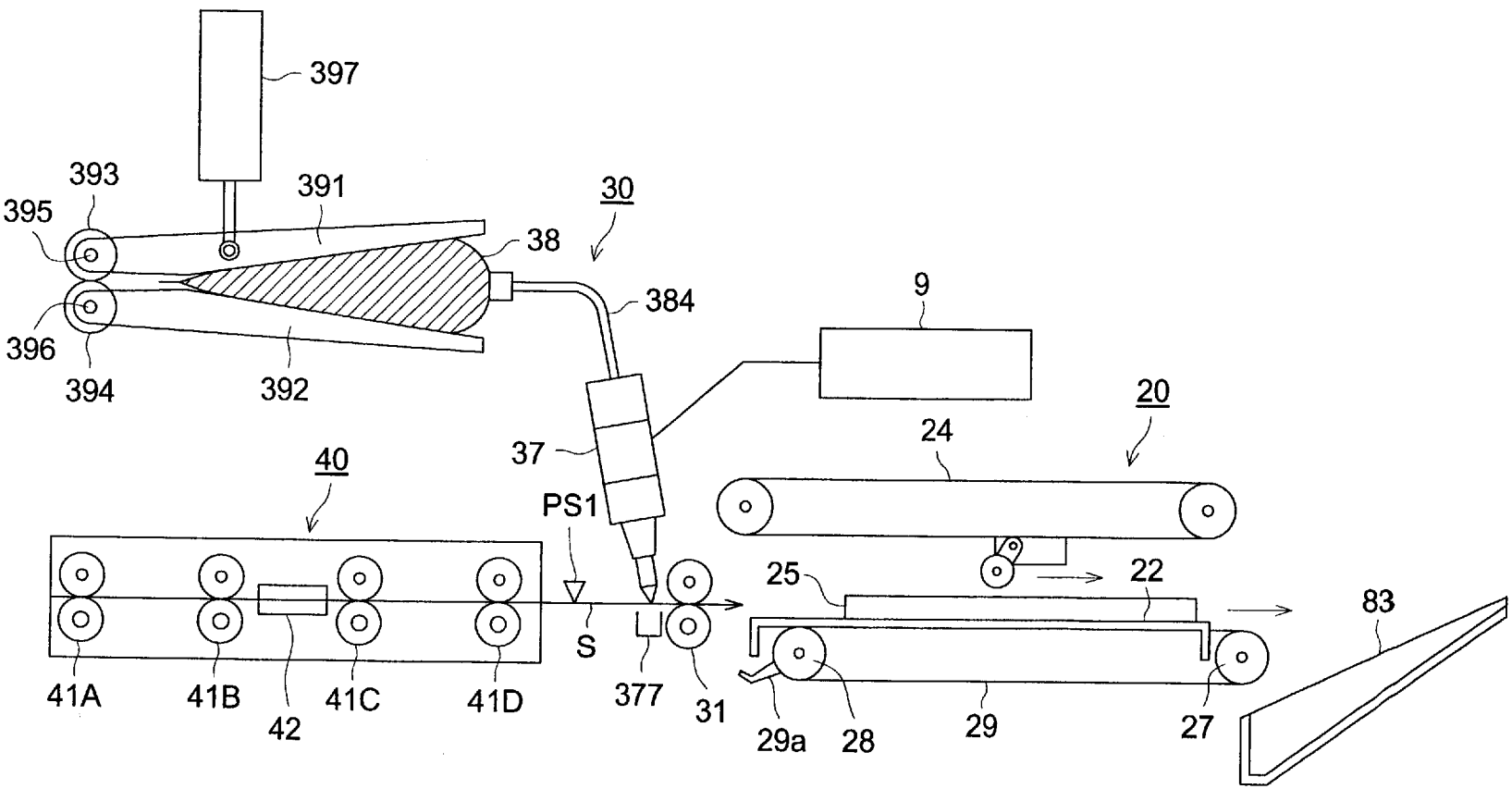
FIG. 8 is a schematic drawing showing the process of pasting-binding.
Figure 9:
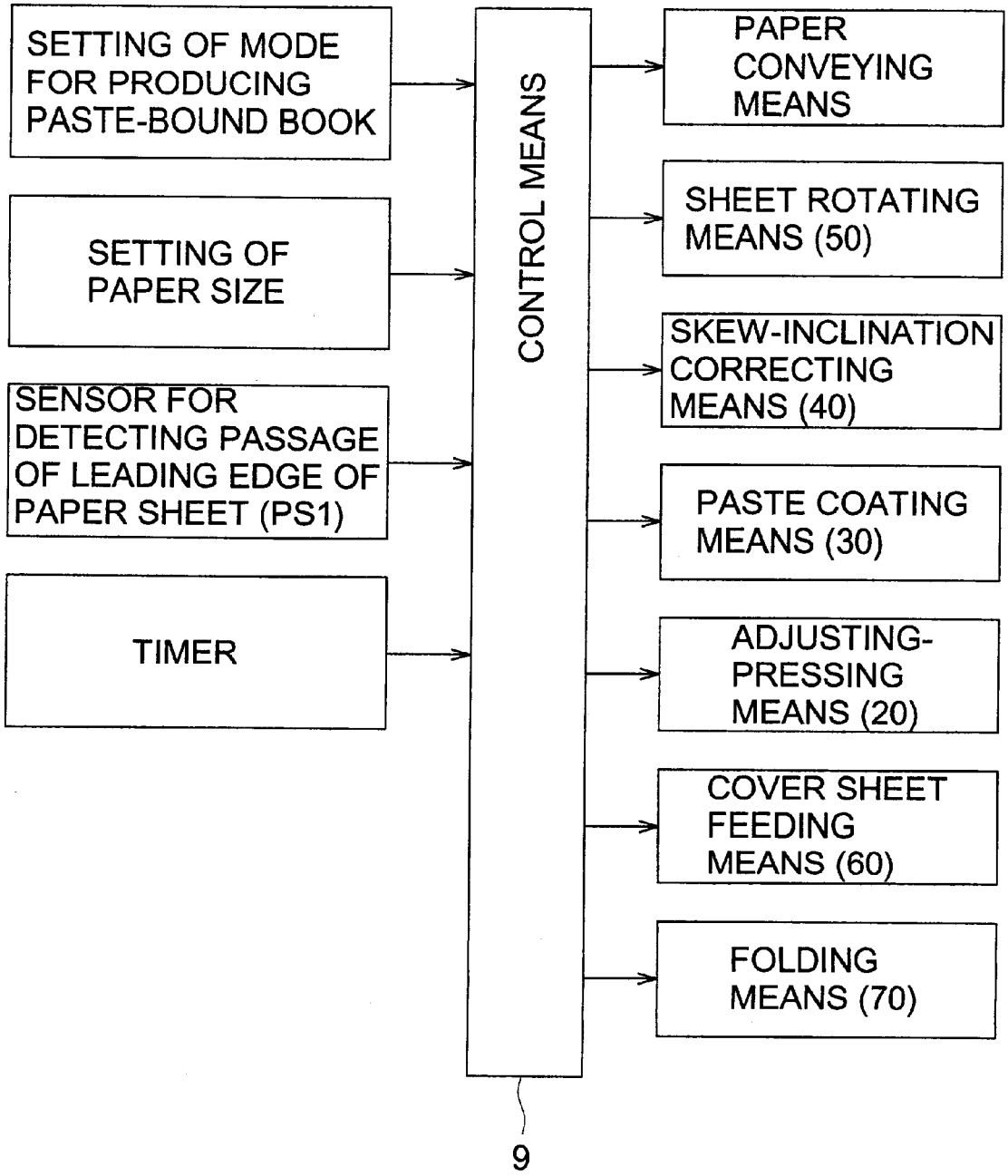
FIG. 9 is a block diagram showing the control of a pasting-binding apparatus.

FIG. 8 is a schematic drawing showing the process of pasting-binding, and FIG. 9 is a block diagram showing the control of a pasting-binding apparatus.

The paper sheet S, which has been trued up at one side by the width adjusting means 42 of the skew-deviation correcting means 40, is gripped between the conveying rollers 41A–41D and conveyed, to progress to the paste coating means 30. When it is detected that the leading edge of the paper sheet S passes the sensor PS1 for detecting the passage of leading edge of the paper sheet, after a passage of a predetermined time from the generation of the detection signal, the ejection of paste by the paste ejecting means 37 is started. That is, the control means 39 instructs the driving of the electromagnetic valve 373 of the paste ejecting means 37.

The control of the time of paste ejection by the paste ejecting means 37 is determined by the length of the paper sheet S in the conveying direction and the paper transport speed by the conveying rollers.

Further, before the passage of the paper sheet S through the sensor PS1, the control means 9 actuates the electromagnetic valve 373 of the paste ejecting means 37, to eliminate the solidified paste at the end portion of the nozzle member 371 as the occasion may demand.

The shape of the coating of paste on the paper sheet S by the paste ejecting means 37 may be a continuous straight line, or an intermittent broken line. In the case where a punching process has been applied to the paper sheet S, the paste is ejected intermittently on a broken-line-shaped area avoiding the holes. These variable control of the paste ejection is carried out through the on-and-off driving of the electromagnetic valve by the control means 9.

The number of the opening 371*a* of the nozzle member 371 in the above-described paste ejecting means 37 should not be limited to one. It is possible that a plurality of openings 371*a* are provided and paste is ejected simultaneously from the plural positions to form a plurality of coated lines.

Besides, it is also possible that a plurality of the above-described paste ejecting means 37 are arranged and paste is ejected simultaneously from the plural positions to form a plurality of coated lines.

Figure 10:
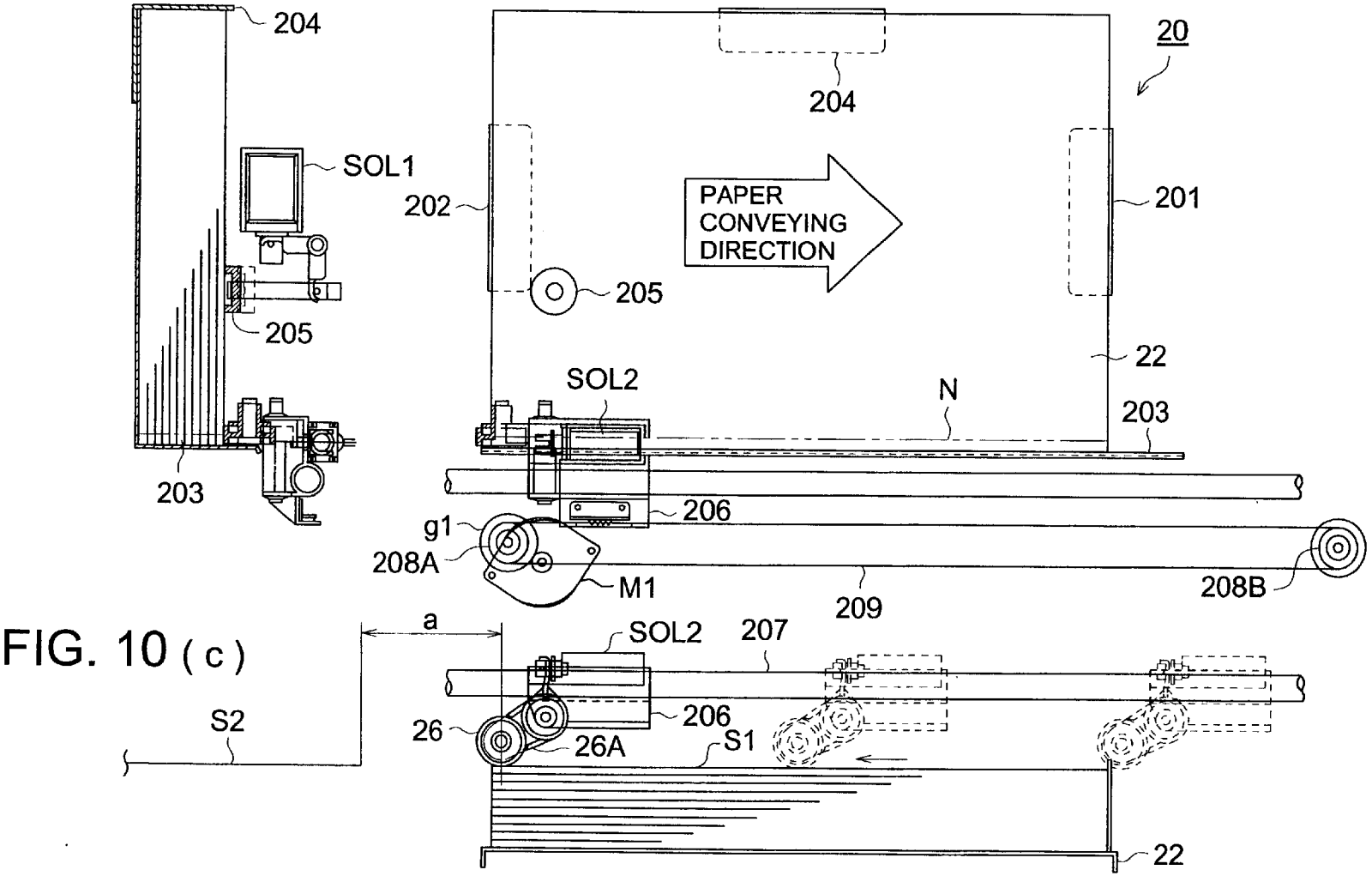
FIGS. 10(*a*) to 10(*c*) are the plan, the side view, and the front view showing the first embodiment of an adjusting-pressing means of this invention.
Figure 11:
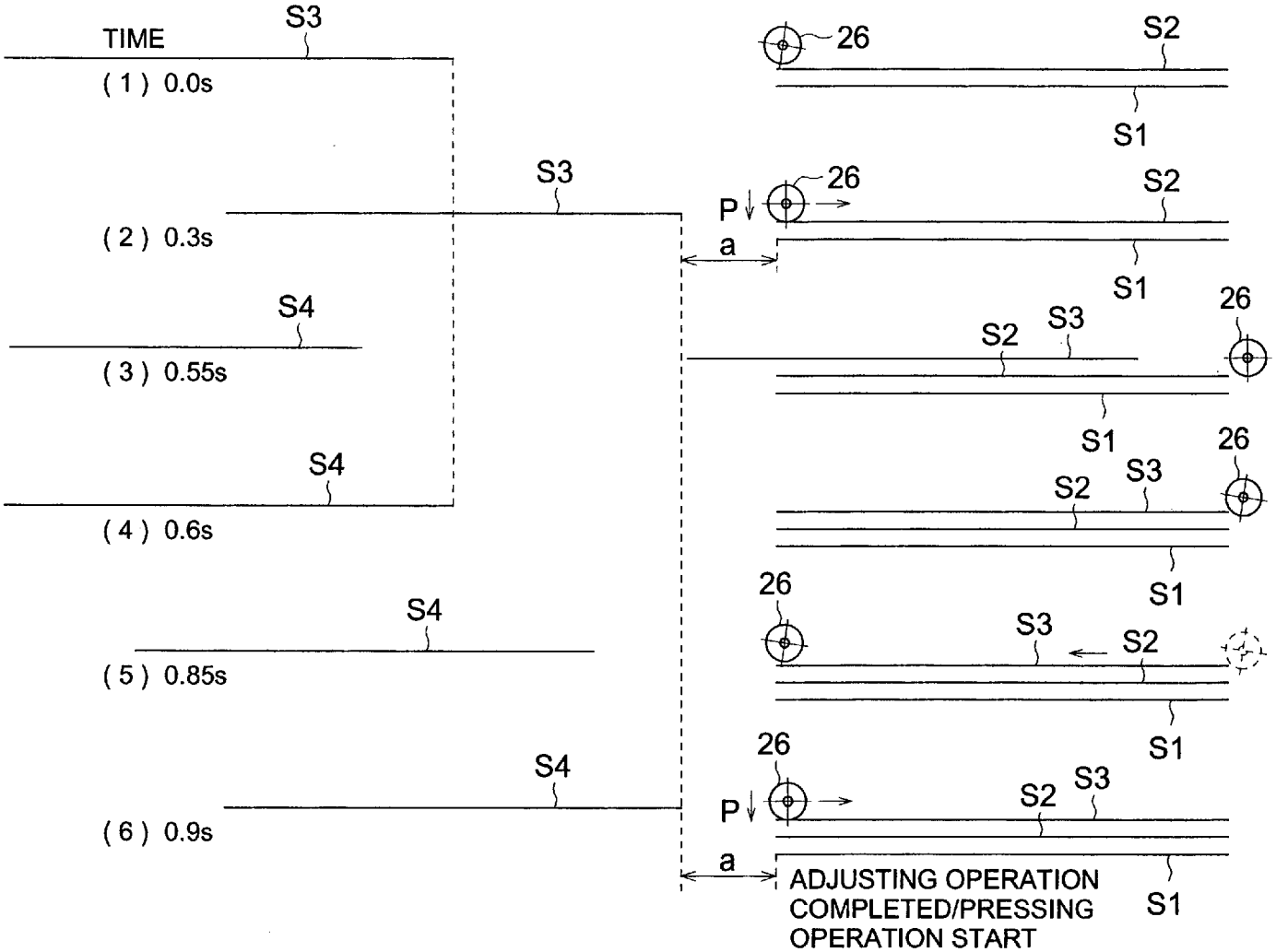
FIG. 11 is a schematic drawing for explaining the process of stacking, adjusting, and pressing.

FIGS. 10(*a*) to 10(*c*) and FIG. 11 show the first embodiment of the adjusting-pressing means 20 of this invention; FIG. 10(*a*) is the plan, FIG. 10(*b*) is the side view, and FIG. 10(*c*) is the front view of the adjusting-pressing means 20. FIG. 11 is a schematic drawing for explaining the process of stacking, adjusting, and pressing of paper sheets.

This adjusting-pressing means 20 is composed of the paper accommodating section 22 which is capable of moving up and down, and the pressing means which presses while moving along the trailing edge of the paper sheet S, which has already been subjected to paste coating and is stacked in the paper accommodating section 22.

The paper accommodating section 22 has a stopper means and an adjusting means. The stopper means is composed of the basic plate 201 for stopping the paper sheet S, of which the leading edge is brought into contact with the basic plate 201, to be placed at a predetermined position in the paper accommodating section 22, and the adjusting plate 202 for pressing the trailing edges of paper sheets of various sizes. The adjusting means is composed of the basic plate 203 for truing up the one side edges of paper sheets at a predetermined position in the direction of the paper width which is perpendicular to the conveying direction, and the adjusting plate 204 for pressing the other side edges of paper sheets of various sizes.

The paper sheet S, which has been placed at the predetermined position in the paper accommodating section 22 by the stopper means and the adjusting means, is pressed or released from being pressed by the sheet pressing member 205 which is driven by the solenoid SOL1.

The pressing roller member 26 is supported by the sliding member (carriage) 206 in a manner capable of oscillating. The pressing roller member 206 is urged by a spring not shown in the drawing, and presses the upper surface of the paper sheet S which has been fed in. The oscillating member 206A, which supports the pressing roller 26 in a manner capable of oscillating, is oscillated by the driving of the solenoid SOL2, to put the pressing roller member 26 apart from the paper sheet surface.

The sliding member 206 is capable of sliding along the guide bar member 207, which is mounted in the direction parallel to the paper transport. The motor M1 drives the driving pulley 208A to rotate through the gear train g1, to let it revolve the endless belt 209, which is entrained between the driving pulley 208A and the driven pulley 208B. The sliding member 206 engages with the endless belt 209 capable of revolving at its one side end and moves back and forth along the guide bar member 207.

After the paper sheet S has been positioned correctly in the paper accommodating section 22 by the adjusting means, [the pressing roller member 26 is released from the engagement with the engaging portion of the sliding member by the solenoid SOL2], the oscillating member 26A is released from being pulled up by the solenoid SOL2, and the pressing roller member 26 is urged by the spring to press the upper surface of the paper sheet S, and at the same time, by the start of driving of the motor M1, is made to start moving in the paper conveying direction, to progress while pressing the trailing edge of the paste-coated portion N formed on the paper sheet S.

During this pressing process applied to the preceding paper sheet S1 by the pressing roller member 26, the leading edge of the succeeding paper sheet S2 reaches the position at the distance a from the trailing edge of the preceding paper sheet S1.

After the completion of pressing the trailing edge of the paste-coated portion N by the pressing roller member 26, the solenoid SOL2 is driven to let the oscillating member 26A oscillate to engage with the engaging portion of the sliding member 206, and the pressing roller member 26 is put apart from the surface of the paper sheet. At approximately the same time, by the reverse driving of the motor M1, the pressing roller member moves into the returning process, and comes to the initial position again.

Next, the process of stacking, adjusting, and pressing of the paper sheets by the adjusting-pressing means of this invention will be explained with reference to the schematic drawing of FIG. 8 in the following.

(1) The first paper sheet S1 is placed in the paper accommodating section 22, and next, the second paper sheet S2, which has already been subjected to paste coating process, is placed on the paper sheet S1 in the paper sheet receiving unit 22; then, it is started the position determining operation by the stopper means and the adjusting means.

(2) After the completion of the position determining operation by the stopper means and the adjusting means, the solenoid SOL1 lets the paper sheet pressing member 205 move down to press the upper surface of the paper sheet. Further, by the start of driving of the motor M1, it is started the pressing operation (load P) by the movement of the pressing roller member 26. At this time, the succeeding paper sheet S3 is still standing with its leading edge positioned at the very short distance a from the trailing edge of the preceding paper S2.

(3) After the completion of the pressing process applied to the second paper sheet S2 by the pressing roller member 26, the upward movement of the paper accommodating section 22 is started. During this, the paper sheet pressing member 205 moves upward to be kept apart from the surface of the paper sheet, and the third paper sheet S3 progresses into the paper sheet receiving unit 22.

(4) After the completion of the upward moving operation of the paper accommodating section 22 and the placement of the third paper sheet S3, the adjusting operation for the third paper sheet S3 is started.

(5) At approximately the same time, the solenoid SOL2 and the motor M1 are driven, to let the pressing roller member move into the returning process and come to the initial position.

(6) After the completion of the adjusting process applied to the third paper sheet S3, again by the start of driving the solenoid SOL2 and the motor M1, the pressing operation (load P) by the pressing roller member 26 is started. At this time, the paper sheet pressing member 205 moves upward to be kept apart from the upper surface of the paper sheet, and the succeeding paper sheet S4 is still standing with its leading edge positioned at the very short distance a from the trailing edge of the preceding paper sheet S3. After this, the above-described processes are to be repeated.

Figure 12:
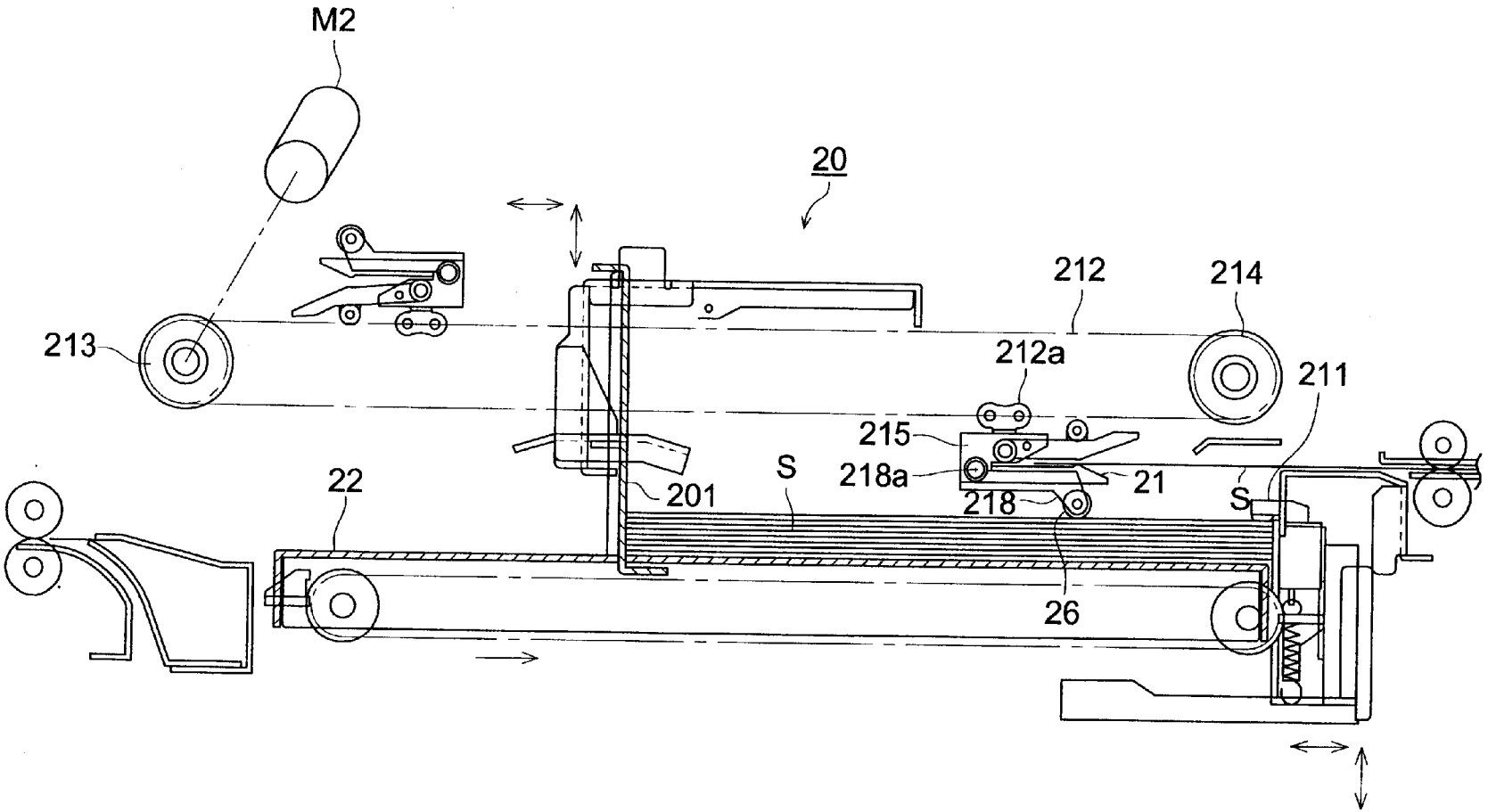
FIG. 12 is the front view of the pasting pressing means showing the second embodiment of an adjusting-pressing means of this invention.
Figure 13:
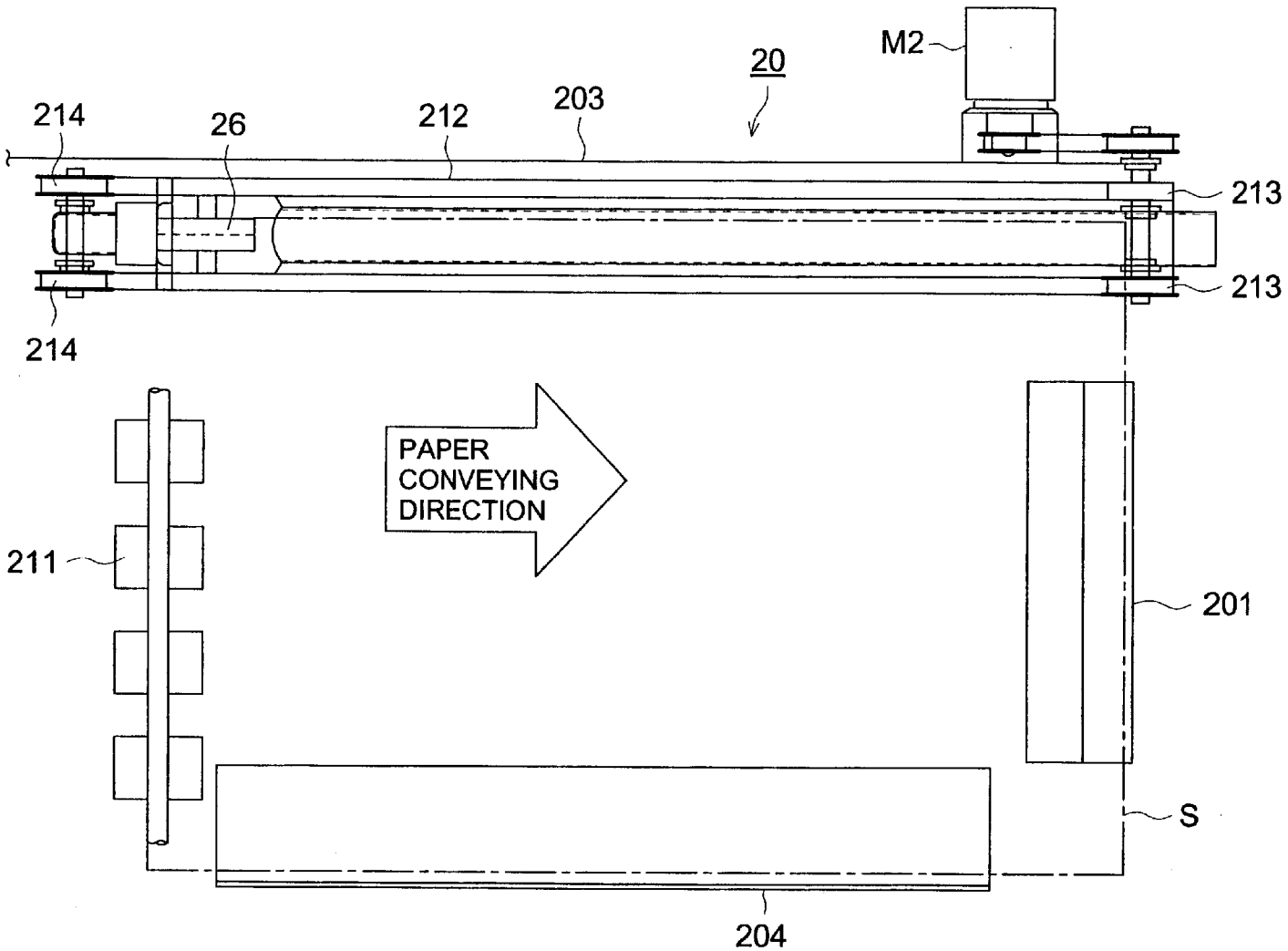
FIG. 13 the plan of the above-described adjusting-pressing means.
Figure 14:
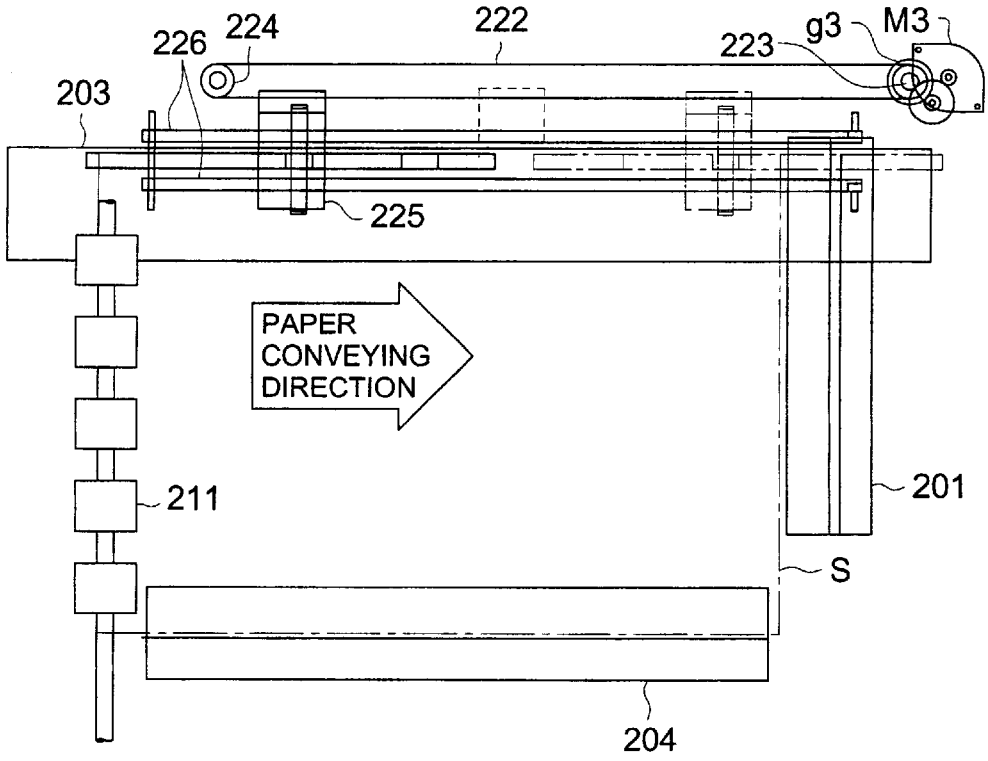
FIGS. 14(*a*) and 14(*b*) are the plan and the front view showing the third embodiment of an adjusting-pressing means of this invention.
Figure 14:
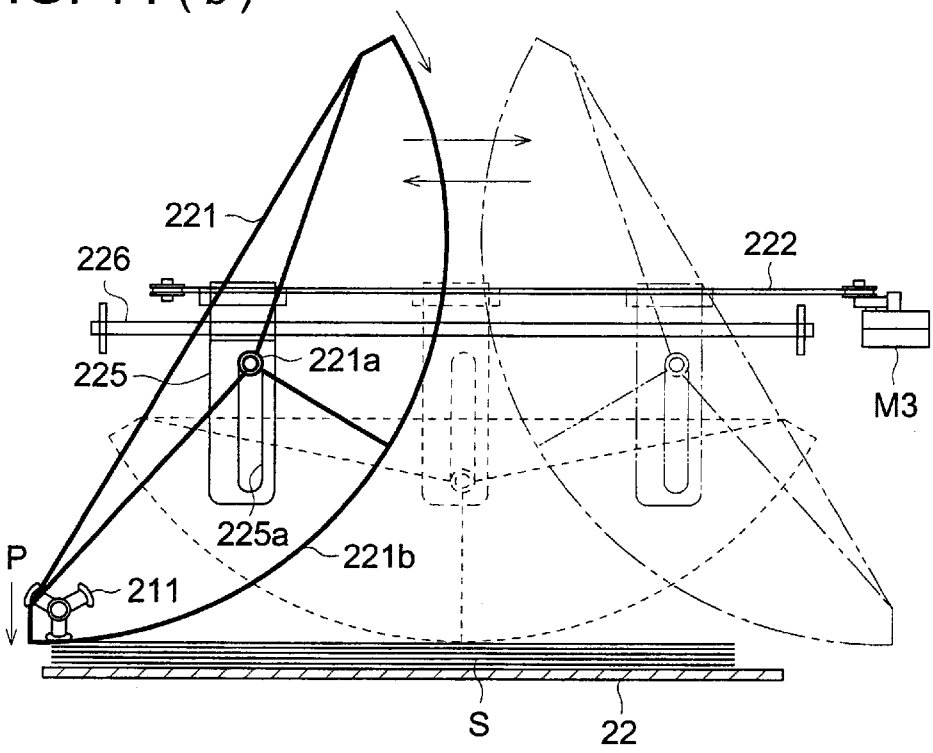

FIG. 12, FIG. 13, and FIGS. 14(*a*) and 14(*b*) show the second embodiment of the adjusting-pressing means of this invention; FIG. 12 is the front view of the pasting pressing means, and FIG. 13 is the plan of the adjusting-pressing means. In addition, regarding the signs used in the drawings, the same signs as those used in FIG. 2 and FIG. 10 are attached to the parts having the same function.

This adjusting-pressing means 20 is composed of the paper accommodating section 22 which is capable of moving up and down, and the pasting pressing means which presses and moves along the trailing edge of the paper sheet S, which has already been subjected to paste coating and is placed in the paper accommodating section 22.

The paper accommodating section 22 has a stopper means and an adjusting means. The stopper means is composed of the basic plate 201 for stopping the paper sheet S, of which the leading edge is brought into contact with the basic plate 201, to be placed at a predetermined position in the paper accommodating section 22, and the sheet pressing member 211 which presses the trailing edges of paper sheets of various sizes. The adjusting means is composed of the basic plate 203 for truing up one side edges of paper sheets at a predetermined position in the direction of the paper width which is perpendicular to the conveying direction, and the adjusting plate 204 for pressing the other side edges of paper sheets of various sizes.

The paper sheet S, which has been conveyed in the paper accommodating section 22 by the gripper means 21, is placed correctly to the predetermined position by the stopper means and the adjusting means.

The pasting pressing means is composed of the two sets of pressing roller members 26 which are fixed to the rotatable endless belts 212. The driving pulleys 213 driven by the motor M2 rotates the driven pulley 214 and the endless belts 212 which are entrained around the both pulleys.

At each of two positions of the endless belts 212 (chain), the supporting section 212*a* is formed integrally, and to this supporting sections 212*a*, the roller mounting member 215 is fixed.

At a part of the roller mounting member 215, the pressing roller holding member 218 for supporting the pressing roller member 26 in a rotatable manner is supported by the supporting shaft 218*a* in a manner capable of oscillating. The pressing roller holding member 218 is urged by the spring, to press the pressing roller member 26 to the paper sheet S with the predetermined load P.

The paper sheet S, which has been conveyed in the paper accommodating section 22, is placed correctly at the predetermined position, and then, by the movement of the pressing roller member 26, which is supported in a rotatable manner by the roller mounting member 215 fixed to the revolving endless belts 212, presses with the predetermined load P the trailing edge of the line-shaped or dot-shaped paste-coated portion in the neighborhood of the one side of the paper sheet S, to form a paste layer having a shape of uniform thin film to bond the sheet to the preceding paper sheet.

FIGS. 14(*a*) and 14(*b*) shows the third embodiment of the adjusting-pressing means 20 of this invention; FIG. 14(*a*) is the plan, and FIG. 14(*b*) is the front view. In addition, regarding the signs used in the drawings, the same signs as those used in FIG. 13 showing the second embodiment are attached to the parts having the same function. Further, only the points which are different from the second embodiment will be explained.

This adjusting-pressing means 20 is composed of the paper accommodating section 22 which is capable of moving up and down, and the pasting pressing means which presses and moves along the trailing edge of the paper sheet S, which has already been subjected to paste coating and is placed in the paper accommodating section 22.

The paper accommodating section 22 has a stopper means and an adjusting means. The stopper means and the adjusting means have the same structure as those in the above-described second embodiment.

The pasting pressing means is composed of the pressing member 221 and a driving means. The pressing member 221 comprises the rotary shaft 221*a* and the cylindrical surface portion 221*b*, and is capable of moving back and forth in the paper conveying direction and oscillating by the driving means.

The driving means is composed of the motor M3, which is the drive source, the gear train g3, the driving pulley etc. The motor M3 drives the driving pulley 223 to rotate through the gear train g3, and makes the endless belt 222, which is entrained between the driving pulley 223 and the driven pulley 224, revolve. The moving member 225 engages with the one side end of the endless belt 222 capable of revolving and moves straight back and forth along the two guide bar members 226.

The long slot 225*a*, which is provided by boring in the moving member 225 is disposed at an approximately vertical position to the paper surface, and the rotary shaft 221*a* of the pressing member 221 is inserted in it. The rotary shaft 221*a* is urged to the lengthwise direction of the long slot 225*a* and to the paper surface side, by a spring not shown in the drawing. Owing to this, the cylindrical surface portion 221*b* of the pressing member 221 is always in linear contact with the paper sheet surface.

The pressing member 221, which is shown by the solid lines in FIG. 14(*b*), is shown in the drawing in the state of starting the pressing against the paper sheet S, which has already been subjected to paste coating and is received in the paper accommodating section 22. In this condition, the portion near the one end of the cylindrical surface portion 221*b* of the pressing member 221 presses (load P) the portion near the trailing edge in the paper conveying direction of the paper sheet S. At this time, the rotary shaft 221*a* is regulated by the side wall of the long slot 225*a* and the cylindrical surface portion 221*b* being in contact with the paper sheet surface, to be positioned at the upper end portion of the long slot 225*a*.

The broken line in FIG. 14(*b*) shows the moving member 225 and the pressing member 221 located at an intermediate position. By the movement of the moving member 225 in the horizontal direction and the descending of the rotary shaft 221*a*, the pressing member 221 oscillates and moves as pressing the paper surface, to press and roll the trailing edge of the paste-coated portion of the paper sheet S.

Subsequently to the above, when the endless belt 222 is made to revolve by the driving of the motor M3 and the moving member 225 is moved straight to right in the horizontal direction, the rotary shaft 221*a* of the pressing member 221 rises up along the long slot 225*a*, to reach the portion near the upper end of the long slot 225*a*.

The double dot and dash line in FIG. 14(*b*) shows the moving member 225 and the pressing member 221 located at the last position in the forth movement. By the horizontal movement of this pressing member 225, the pressing member 221 oscillates and moves as subsequently pressing the paper surface to press and roll the trailing edge of the paste-coated portion of the paper sheet S.

After the completion of the pressing process applied to the paper sheet S, the pressing member 221 is stopped at the position shown by the double dot and dash line in the drawing, to make it possible to receive a succeeding paper sheet. The succeeding paper sheet is conveyed onto the preceding paper sheets stacked in the paper accommodating section 22 and adjusted.

After the adjustment, the endless belt 222 is made to revolve in the reverse direction by the reverse driving of the motor M3, the moving member 225 is moved straight to left in the horizontal direction, the pressing member 221 is moved in the back direction reverse to the forth movement, and the pressing member 221 oscillates and moves as pressing the paper surface to press and roll the trailing edge of the paste-coated portion of the succeeding paper sheet. After the pressing process applied to the paper sheet, the pressing member again passes the forth moving path, and is stopped at the position shown by the double dot and dash line, to make it possible to receive a further succeeding paper sheet.

Figure 15:
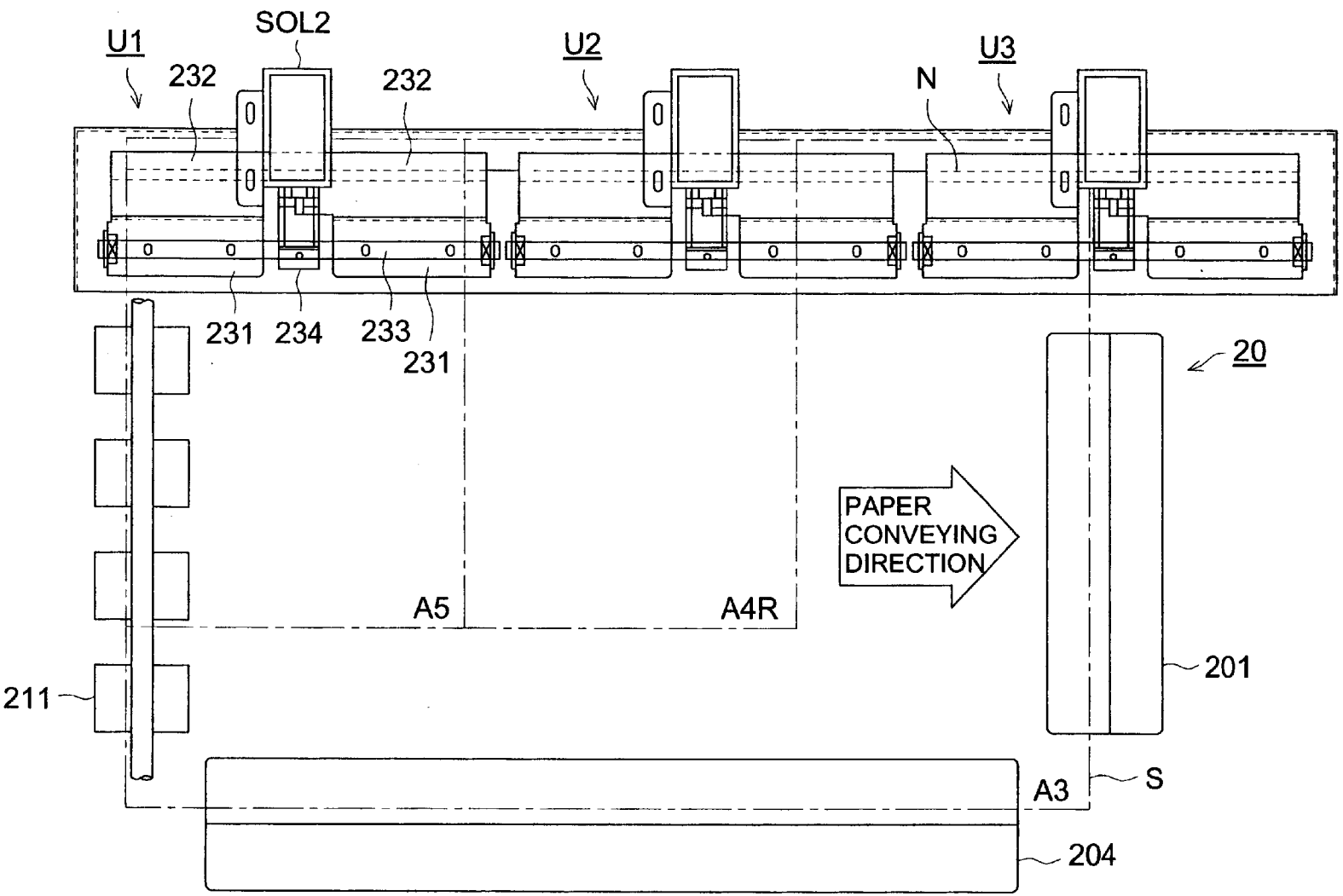
FIG. 15 is the plan showing the fourth embodiment of an adjusting-pressing means of this invention.
Figure 16:
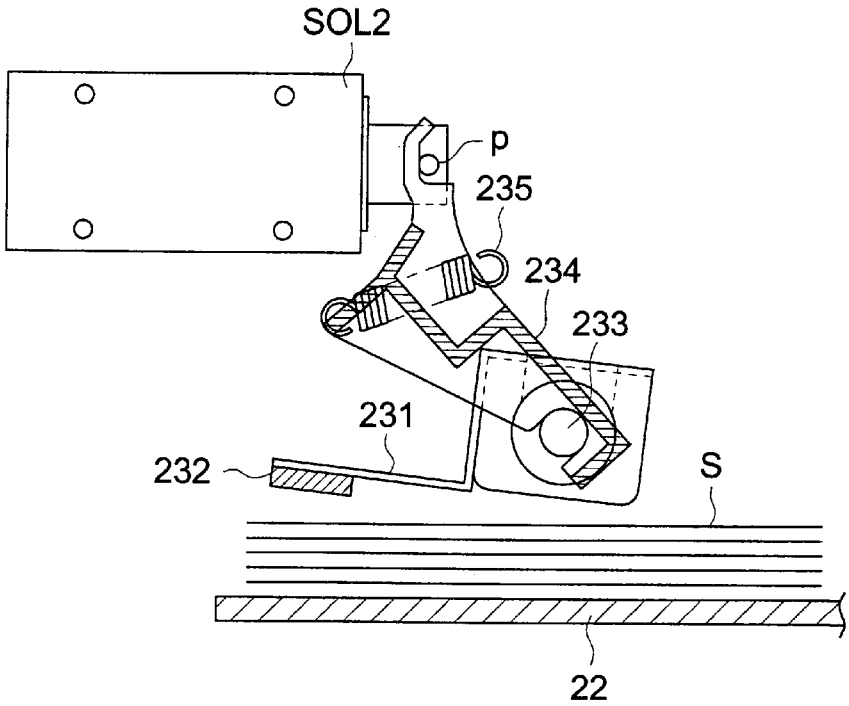
FIGS. 16(*a*) and 16(*b*) are the front view showing a pasting pressing means in the inactivated state and the front view showing the same in the actuated state.
Figure 16:
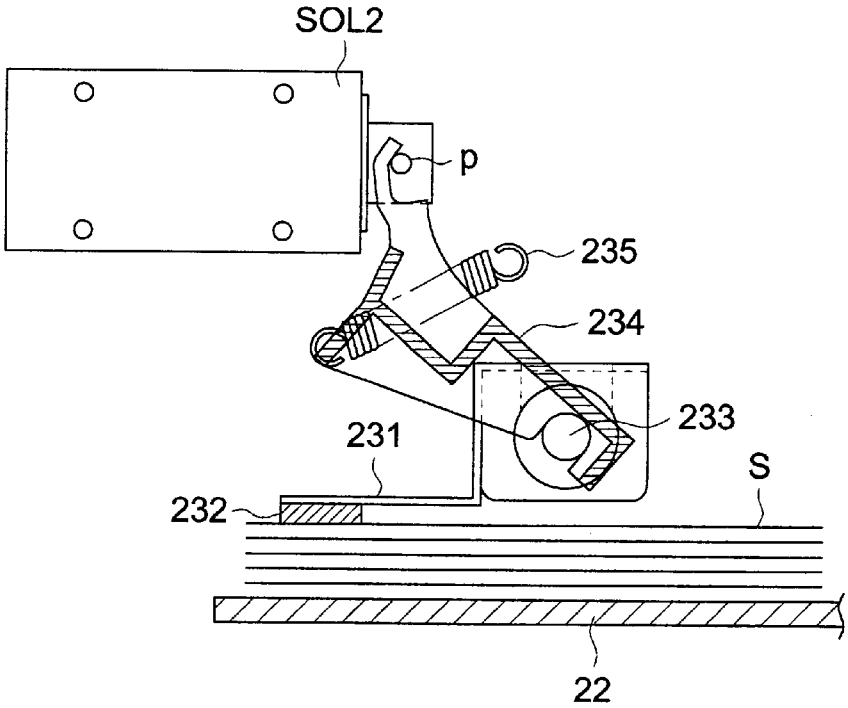

FIG. 15 and FIGS. 16(*a*) and 16(*b*) show the fourth embodiment of the adjusting-pressing means of this invention. FIG. 15 is the plan of the adjusting-pressing means 20, FIG. 16(*a*) is the front view showing the pasting pressing means in the inactivated state, and FIG. 16(*b*) is the front view showing it in the actuated state. In addition, regarding the signs used in the drawings, the same signs as those used in FIG. 13 showing the second embodiment are attached to the parts having the same function. Further, only the points which are different from the second embodiment will be explained.

The stopper means and the adjusting means, which are provided in the paper accommodating section 22 capable of moving up and down of this adjusting and pressing means 20, have the same structure as those in the second embodiment.

The pasting pressing means is composed of the pressing member 231 capable of oscillating and a driving means. As shown in FIG. 15, the pasting pressing means is composed of the plural sets of pasting pressing units U1, U2, and U3 disposed in an serial arrangement in the neighborhood of the side edge of the paper sheet S, which has the paste-coated portion N formed on it. These plural sets of pasting pressing units U1, U2, and U3 have the same structure, therefore, the paste pressing U1 as the representative of them will be explained in the following.

The elastic member 232, which is stuck to one end portion of the pressing member 231, is to be brought into pressure contact with the paper surface. The other end portion of the pressing member 231 is fixed to the rotary shaft 233, and is capable of oscillating. One end of the lever 234 is fixed to the rotary shaft 233, and together with the pressing member 231, it is supported in a manner capable of oscillating. The lever 234 is urged by the spring 235, and the front end portion of the lever 234 is in pressure contact with the pin p, which is planted in the plunger of the solenoid SOL2.

In the state of the solenoid SOL2 shown in FIG. 16(*a*) to which an electric voltage is not applied, the plunger projects and the lever 234 is urged by the spring 235, to oscillate the rotary shaft 233 and the pressing member 231 in the clockwise direction. In this state, the elastic member 232 is located apart from the paper surface, to make it possible for paper sheets to be conveyed and adjusted.

When an electric voltage is applied to the solenoid SOL2, the plunger is attracted to retract, and moves the front end portion of the lever 234 engaging with the pin p. By this action, the lever 234 is oscillated around the rotary shaft 233 in the counter-clockwise direction; at the same time, the pressing member 231 is also oscillated in the counter-clockwise direction, and the elastic member 232 descends to be in pressure contact with the paper surface, which is the state shown in FIG. 16(*b*).

As shown in FIG. 15, the pressing member 231 is formed to have approximately the same length as the smallest paper length (for example, the length of the shorter side of A5 size paper) in the paper conveying direction. The lever 234 is fixed at the central portion of the rotary shaft 233 in the lengthwise direction, to engage with the plunger.

The plural sets of the pasting pressing units composed of the driving means composed of the solenoid SOL2, the rotary shaft 233, the spring 235, etc. and the pasting pressing unit composed of the pressing member 231 and the elastic member 232 are arranged in the paper conveying direction (the three sets of pasting pressing units U1, U2, and U3 shown in the drawing), and presses uniformly the trailing edge of the paste-coated portion of the paper sheets of various sizes.

For example, for an A4-sized paper sheet, only the pasting pressing unit U1 is actuated to press the side edge portion of the paper sheet. For an A4R-sized paper sheet, two sets of the pasting pressing units U1 and U2 are actuated. For an A3-sized paper sheet, three sets of the pasting pressing units U1, U2, and U3 are actuated. In the case where the plural sets of the pasting pressing units are actuated, it is appropriate to actuate every solenoid SOL2 simultaneously, or it is also appropriate to actuate them sequentially at staggered timings.

Figure 17:
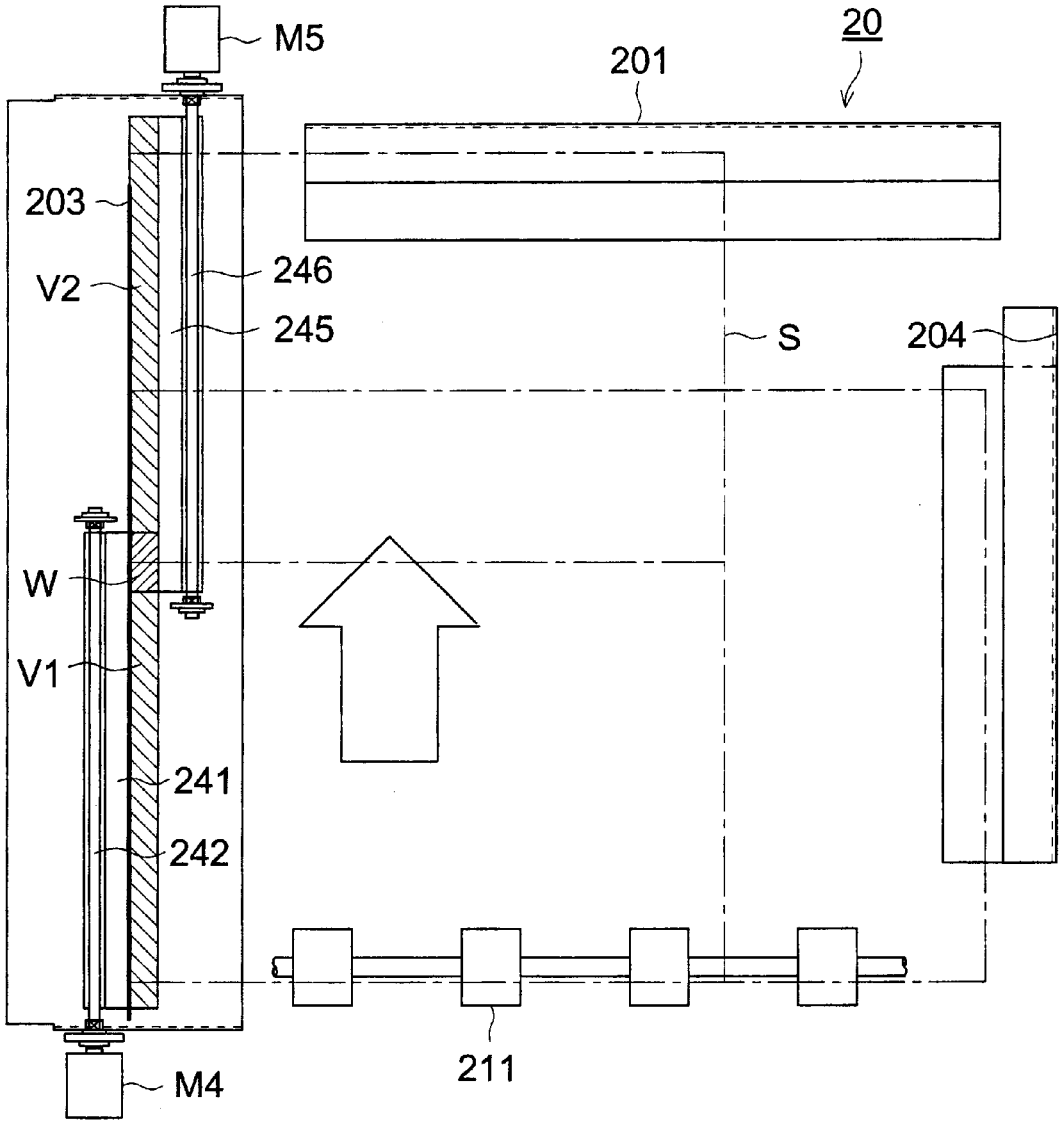
FIG. 17 the front view showing the fifth embodiment of an adjusting-pressing means of this invention.
Figure 20:
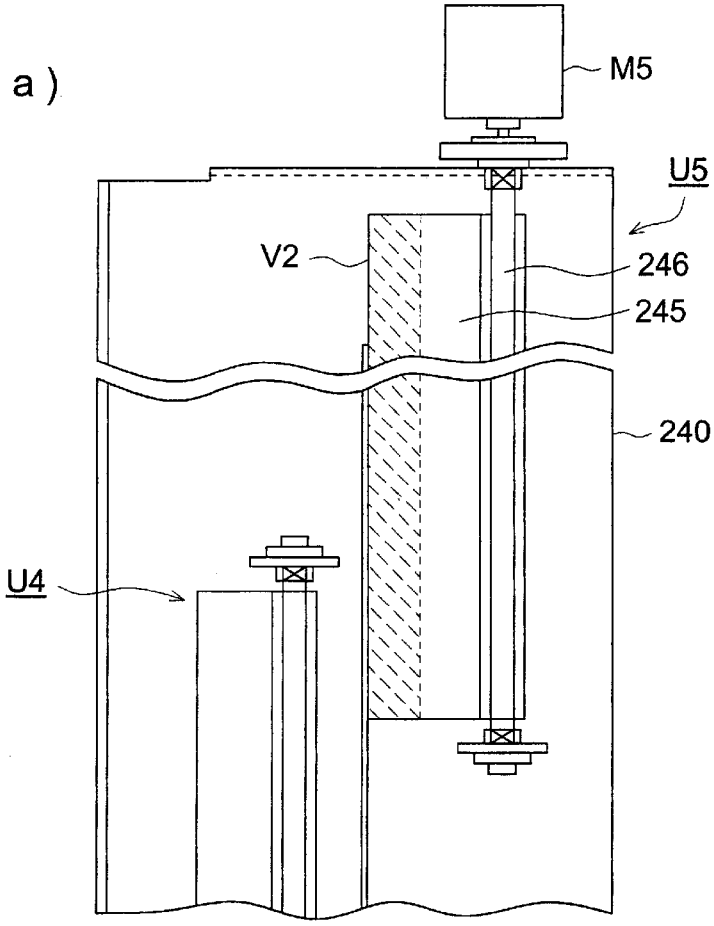
FIGS. 20(*a*) and 20(*b*) are a partial plan and a partial front view showing a pasting pressing unit in the actuated state.
Figure 20:
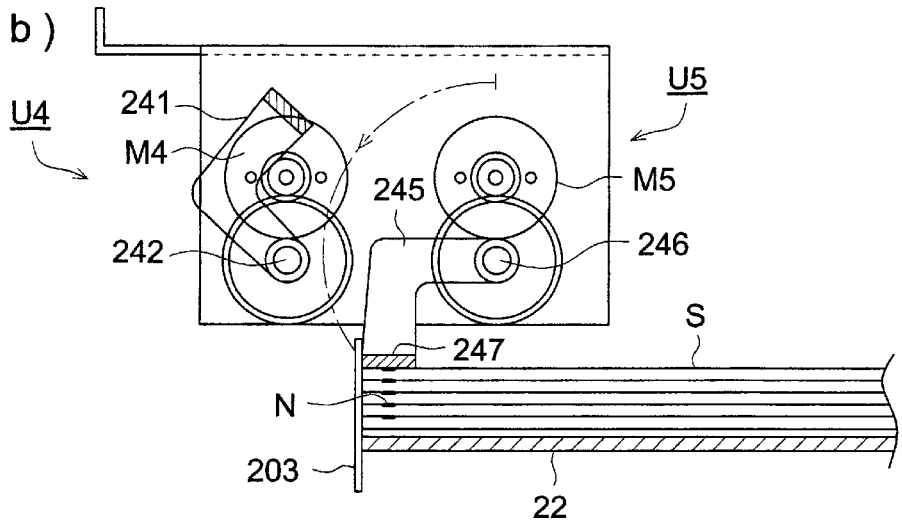

FIG. 17 FIGS. 20(*a*) and 20(*b*) show the fifth embodiment of the adjusting-pressing means of this invention. FIG. 17 is the plan of the adjusting-pressing means, FIG. 18(*a*) is the plan and FIG. 18(*b*) is the front view showing the pasting pressing means in the inactivated state. In addition, regarding the signs used in the drawings, the same signs as those used in FIG. 13 showing the second embodiment are attached to the parts having the same function. Further, only the points which are different from the second embodiment will be explained.

The stopper means and the adjusting means, which are provided in the paper accommodating section 22 capable of moving up and down of this adjusting and pressing means 20, have the same structure as those in the second embodiment.

The pasting pressing means is composed of the two sets of the pasting pressing units U4 and U5. The pasting pressing unit U4 is composed of the pressing member 241, the rotary shaft 242 which is integrally formed with the pressing member 241, and a driving means. The elastic member 243, which is stuck to the front end portion of the pressing member 241, is to be brought into contact with the upper surface of the paper sheet S.

The both end portions of the rotary shaft 242 are supported in a manner capable of rotating by the bearings 244 provided at the housing 240 of the pasting pressing means. The rotary shaft 242 is driven to rotate by the motor M4 through the gear train g5.

The pasting pressing unit U5 is disposed on the housing 240 parallel to the pasting pressing unit U4 in a symmetrical arrangement. The pasting pressing unit U5 has the same structure as the pasting pressing unit U4, and is composed of the pressing member 245, the rotary shaft 247, the bearings 248, the motor M5, and the gear train g6.

Figure 19:
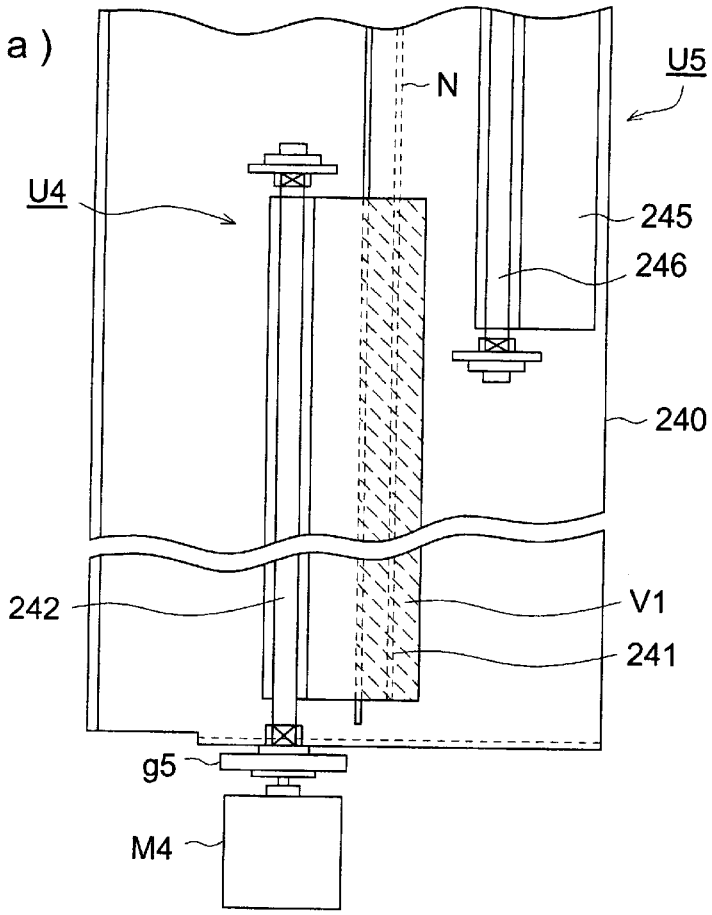
FIGS. 19(*a*) and 19(*b*) are a partial plan and a partial front view showing a pasting pressing unit in the actuated state.
Figure 19:
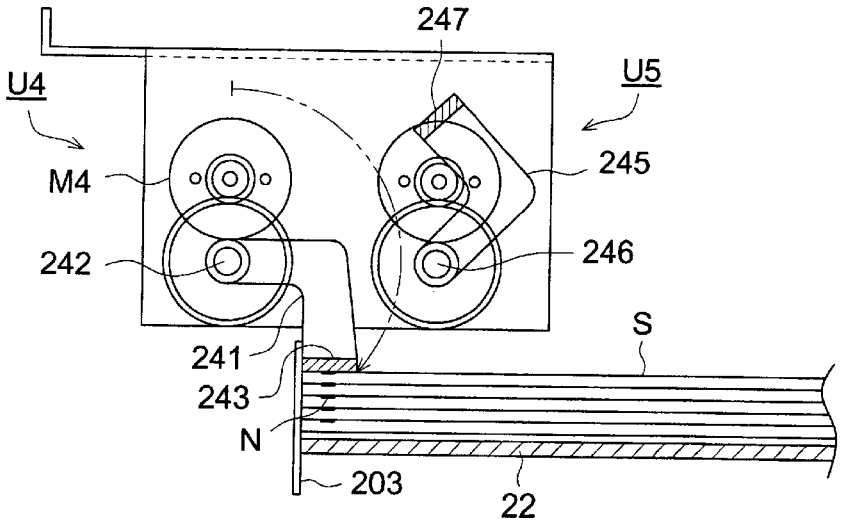

FIG. 19(*a*) is a partial plan and FIG. 19(*b*) is a partial front view showing the pasting pressing unit U4 in the actuated state. By the start of driving of the motor M4, the rotary shaft 242 is rotated through the gear train g5, and the pressing member 241 oscillates to the clockwise direction shown in the drawing, to make the elastic member 243 press the upper surface of the paper sheet S. The area V1 in the paper sheet S which is pressed by the elastic member 243 is shown by the hatching of oblique lines in FIG. 19(*a*). By the pressing load of this pressing member 241, the paste-coated portion N on the trailing edge of the paper sheet is rolled to be bonded to the paper sheet stacked under it.

FIG. 20(*a*) is a partial plan and FIG. 20(*b*) is a partial front view showing the pasting pressing unit U5 in the actuated state. By the start of driving of the motor M5, the rotary shaft 246 is rotated through the gear train g6, and the pressing member 245 oscillates to the counter-clockwise direction shown in the drawing, to make the elastic member 247 press the upper surface of the paper sheet S. The area V2 in the paper sheet S which is pressed by the elastic member 247 is shown by the hatching of oblique lines in FIG. 20(*a*). By the pressing load of this pressing member 245, the paste-coated portion N on the trailing edge of the paper sheet is rolled to be bonded to the paper sheet stacked under it.

The pressing member 241 of the pasting pressing unit U4 and the pressing member 245 of the pasting pressing unit U5 are actuated alternately to press the line-shaped paste coated portion N formed on the trailing edge of the paper sheet S. The pressing member 241 and the pressing member 245 are disposed in an arrangement such that the area V1 to be pressed by the pressing member 241 and the area V2 to be pressed by the pressing member 245 overlap each other near the central part, to form the overlapped pressed area W (refer to FIG. 17).

As shown in FIG. 17, the pressing members 241 and 245 are formed to have a length longer than the half length of the largest paper (for example, the length of the longer side of A3 size paper sheet) in the paper conveying direction, to form the overlapped pressed area W; therefore, an area that is not to be pressed is not produced, to make it possible to carry out a reliable pressing process. That is, by alternately actuating the mutually neighboring pressing members 241 and 245 to have a part of the pressed area overlapped, the pressing process can be practiced over the whole area of the paper sheet to be pressed without fail.

The bookbinding apparatus of this invention is connected to an image forming apparatus such as a copying machine, a printer, or a compound machine of these. By an image-forming apparatus provided with the bookbinding apparatus B of this invention, for the paper sheets, which have been subjected to a desired digital processing and a processing such as a simplex recording or duplex recording and a page edition and ejected by the image forming apparatus, the conversion processing of paper conveying direction and the pasting process can be carried out accurately and efficiently, and bookbinding is made.

Further, it is also possible to connect a bookbinding apparatus of this invention to an after-copy sheet processing apparatus (finisher) which carries out a stapling process for a bundle of paper sheets.

Moreover, it is also possible that a bookbinding apparatus of this invention is formed as an independent apparatus, by which the conversion processing of paper conveying direction and the pasting-binding process are carried out for a bundle of paper sheets which have been processed and collated by another image forming apparatus.

As can be understood clearly by the foregoing explanation, the following effects can be obtained by the pasting-binding apparatus of this invention.

(1) The total width dimension and the depth dimension of the pasting-binding apparatus can be made small to reduce the installment area by it, that the sheet rotating means, the paste coating means, and the adjusting-pressing means are disposed in an arrangement of vertical direction from bottom to top, and the paper conveying passages through the sheet rotating means, paste coating means, and the adjusting-pressing means are arranged in the reversed S-shape or S-shape taking the route from the lower part of the apparatus successively to the upper part. Further, by disposing the adjusting-pressing means at the uppermost part of the apparatus, it has an advantage that the paper sheet bundle stacking means, which receives bundles of paper sheets after the pasting-binding process and moves up and down, can be made large-sized. Furthermore, because the paper sheet bundle stacking means is disposed at a suitable height position at the side of the apparatus, the ease of operation at the time of taking out the paper sheet bundle after the pasting-binding process is high.

(2) It is possible, by selectively practicing the rotation process of a paper sheet by the sheet rotating means, to cope with a binding process in the longer side direction or in the shorter side direction of paper sheets without restriction in the binding direction for all the paper sizes. Further, it is possible, in the pasting-binding mode and the other paper ejection modes such as the shift ejection mode and the straight ejection mode, to eject paper sheets to a single output paper tray which is common to those modes. Furthermore, it is not necessary to provide a separate means for making paper sheets come to one side because it is possible to make sheets come to one side in the sheet rotating means, which is effective in making the pasting-binding apparatus simplified, small-sized, and in reducing its manufacturing cost.

(3) By providing a skew-deviation correcting means immediately before the paste coating means at the upstream side in the paper conveying direction, the skew and the deviation of the paper sheet, which has passed the sheet rotating means and is conveyed to it, are corrected immediately before the paste coating process, and after that, a paste-coated portion is accurately formed on the paper sheet.

(4) It is possible to carry out pasting-binding for the paper sheets which have been subjected to a center-folding, or Z-folding process by a folding means. Further, paper sheets which have been subjected to a center-folding or Z-folding process, and paper sheets which have not been subjected to a folding process can be paste-bound together. For example, a Z-folding-processed paper sheet of A3 size and an A4-sized paper sheet can be superposed and paste-bound.

(5) Regardless of the setting direction of cover sheets in the paper feeding cassette of the paper feeding means for cover sheets, the direction of a cover sheet can be made to correspond to either directions of the longer side binding and shorter side binding. For example, even in the case where the paper sheet, which has a record made on it and has been ejected from an image forming apparatus, is A4-sized, and the cover sheet, which is set in the paper feeding cassette is A4R-sized, by rotating the paper sheet to the direction suitable for the paste-coated portion by the sheet rotating means, the cover sheet and the paper sheet having a record on it can be superposed and paste-bound. Further, it is also possible that a cover sheet set in the paper feeding cassette is conveyed in the folding means, to apply a two-folding process to it, and is superposed on paper sheets having been subjected to recording, to be paste-bound.

(6) In the adjusting-pressing means, because a succeeding paper sheet is conveyed to the paper accommodating section and received in it at the same time as the pressing operation for the trailing edge of the paper sheet having already been coated with paste, a sufficient time can be allotted to the adjusting process for the paper sheet, to make it possible to carry out a reliable adjusting of the paper sheet. Further, owing to the pressing with linear load by the pressing roller, the pressing load can be reduced in comparison with the simultaneous pressing over the-whole paste-coated area.

(7) When paper sheets are stacked in the paper accommodating section one by one, by pressing a paper sheet with a transport forth of the pressing roller, the bookbinding process can be carried out reliably with a uniform pressure applied to the paste-coated area. Further, by providing two pressing rollers on the revolving endless belt, the bookbinding process can be carried out continuously and smoothly.

(8) Because the pressing of a paper sheet is carried out by the outer diameter portion of the pressing member having the shape of a circular arc while it is rotating, being accompanied by the horizontal movement of the moving member, a reliable press-binding can be done and the operation noise can be reduced.

(9) Because the pressing force for unit length is made constant, and the pressing is carried out for every small number of sheets, a reliable press-binding is accomplished with a light pressing force. Further, only the pressing member corresponding to the paper sheet size needs to be actuated, this invention is effective for reducing a noise and economizing electric power.

(10) By actuating the neighboring pressing members alternately to make the part of their pressing areas overlapped, pressing can be applied to the whole area of a paper sheet to be pressed without fail.

(11) By an image forming apparatus provided with a pasting-binding apparatus of this invention, corresponding to the ejection speed and the size of the plural paper sheets, which have had an image formed and been ejected successively, a pasting process, a folding process, attachment of cover sheet, etc. can be carried out accurately and efficiently, and bookbinding can be efficiently made. Further, it is possible to dispose the paper accommodating section of a bookbinding apparatus at the position corresponding to the paper ejecting unit of an image forming apparatus, and it is easy to connect the pasting-binding apparatus to the image forming apparatus.

What is claimed is:

1. A pasting binding apparatus for binding a bundle of sheets, comprising:

a conveyor which conveys plural sheets serially on a conveying passage in a conveying direction;

a paste coating device which coats a line of paste onto a binding side of a first surface of each sheet conveyed by the conveyor; and a binding device including:

a stacking device which successively receives the sheets from the paste coating device and stacks the plural sheet in a bundle in a manner such that the coated first surface of each of the sheets faces downward; and a pressing device which brings a pressing member in contact with a non-coated second surface of an uppermost sheet of the bundle of sheets so as to press the uppermost sheet onto the bundle of sheets;

wherein the binding device is located above the paste coating device and the conveying passage, and the binding device is arranged such that the coated first surface of the sheets faces downward in the binding device.

2. The pasting binding apparatus of claim 1, further comprising an ejecting port which ejects the bundle of sheets pressed by the pressing device, and a sheet bundle stacking device which stacks a plurality of bundles of sheets ejected through the ejecting port.

3. The pasting binding apparatus of claim 2, wherein the sheet bundle stacking device comprises a tray section on which the plurality of said bundles of sheets are stacked, a lifting section to shift the tray section upward or downward, and a control section to control the lifting section such that the tray section is shifted downward in accordance with an increase in number of the plurality of bundles of sheets stacked on the tray section.

4. The pasting binding apparatus of claim 1, further comprising:

a rotating device which is located upstream of the paste coating device with respect to the conveying direction, and which selectively rotates the conveyed sheets by 90 degrees on a plane parallel to the conveying passage.

5. The pasting binding apparatus of claim 4, wherein the rotating device shifts the conveyed sheets to one side of the conveying passage and conducts both the rotating and the shifting simultaneously.

6. The pasting binding apparatus of claim 4, further comprising a sheet attitude correcting device which is located upstream of the paste coating device and downstream of the rotating device with respect to the conveying direction, and which corrects a curved attitude and an inclined attitude of the conveyed sheets.

7. The pasting device of claim 4, further comprising a folding device which is located upstream of the paste coating device with respect to the conveying direction and which folds the conveyed sheets along a center line of the sheets or in the form of a Z, and a first switching device to switch conveyance of the sheets by the conveying device to one of the paste coating device and the folding device.

8. The pasting binding apparatus of claim 7, further comprising a cover sheet feeding device which is located upstream of the rotating device with respect to the conveying direction and which feeds a cover sheet.

9. The pasting binding apparatus of claim 8, wherein the cover sheet feeding device is located upstream of the folding device with respect to the conveying direction, and the pasting binding apparatus further comprises a second switching device to switch conveyance of the cover sheet fed by the conveying device to one of the paste coating device and the folding device.

10. The pasting device of claim 8, further comprising a size detecting device to detect a size of the cover sheet fed by the cover sheet feeding device.

11. The pasting device of claim 1, further comprising a sheet accommodating section at which the sheets coated with the paste are stacked one after another so as to form the bundle of sheets.

12. The pasting binding apparatus of claim 11, wherein the pressing device comprises a driving section to shift the pressing device at a line speed equal to or higher than a conveying speed of the sheets in the sheet accommodating section so that the pressing device is shifted while pressing the sheets.

13. The pasting binding apparatus of claim 12, wherein the pressing device comprises a gripper to grip each sheet to be stacked in the sheet accommodating section, and wherein the pressing device is shifted with a following sheet gripped by the gripper and presses a sheet previously stacked in the sheet accommodating section while conveying the following sheet into the sheet accommodating section.

14. The pasting binding apparatus of claim 11, wherein the pressing device comprises a pressing head to be brought in pressure contact with a trailing edge portion of the bundle of sheets in the sheet accommodating section, and wherein the pressing device initiates pressing after the pressing head is brought in pressure contact with the trailing edge portion of the bundle of sheets.

15. The pasting binding apparatus of claim 14, wherein the pressing head is controlled such that the pressing head is separated away from the bundle of sheets in the sheet accommodating section before a leading edge of a following sheet is conveyed in the sheet accommodating section.

16. The pasting binding apparatus of claim 11, wherein the pressing device is structured so as to shift while performing a pressing operation and to be brought in contact with or be separated from the sheets stacked in the sheet accommodating section, and wherein the pressing device is controlled such that the pressing device is shifted from a shift starting point to a shift finishing point while performing pressing and thereafter is separated from the sheets and is returned to the shift starting point.

17. The pasting binding apparatus of claim 16, wherein a following sheet is conveyed into the sheet accommodating section before the pressing device is returned to the shift starting point.

18. The pasting binding apparatus of claim 16, wherein the pressing device comprises a plurality of pressing members, and wherein each of the plurality of pressing members is adapted to be driven independently of the others and the plurality of pressing members are driven selectively in accordance with a size of the sheets.

19. The pasting binding apparatus of claim 18, wherein each of the plurality of pressing members presses a predetermined region on the sheets and the plurality of pressing members are arranged so that a region pressed by one of the plurality of pressing members is overlapped with another region pressed by another one of the plurality of pressing members and a neighboring one of the plurality of pressing members moves so as not to interfere with movement of another neighboring one of the plurality of pressing members.

20. The pasting binding apparatus of claim 11, further comprising an edge truing-up section to put in order leading edges of the bundle of sheets stacked in the sheet accommodating section and a side adjusting section to adjust a side of the bundle of sheets so as to locate at one side of the conveying passage.

21. The pasting binding apparatus of claim 1, wherein the pressing member comprises a rotatable pressing head capable of being brought in contact with or separated from the uppermost sheet of the bundle of sheets, and a driving section to shift the pressing head on a condition that the pressing head is brought in contact with the uppermost sheet of the bundle of sheets.

22. The pasting binding apparatus of claim 1, wherein the pressing device comprises an endless belt, a belt driving section to rotate the endless belt and a plurality of pressing heads supported by the endless belt so that the plurality of pressing heads press the uppermost sheet of the bundle of sheets while being shifted with a rotation of the endless belt.

23. The pasting binding apparatus of claim 1, wherein the pressing device comprises a pressing head having a cylindrical surface which is supported to be movable in reciprocation along the uppermost sheet of the bundle of sheets and to be rockable, and a driving section to drive the pressing head so as to be moved in reciprocation and to be rocked.

24. The pasting binding apparatus of claim 23, further comprising a sheet size detecting section to detect a size of the sheets, a leading edge detecting section to detect a leading edge of the sheets, and a control section to control the drive section in accordance with detection results of the sheet size detecting section and the leading edge detecting section.

25. An image forming apparatus, comprising:

an image forming unit which forms images on plural sheets; and a pasting binding unit for binding a bundle of the sheets bearing the images formed by the image forming unit, wherein said pasting binding unit comprises:

a conveyor which conveys the sheets serially from the image forming unit on a conveying passage in a conveying direction;

a paste coating device which coats a line of paste onto a binding side of a first surface of each sheet conveyed by the conveyor; and a binding device including:

a stacking device which successively receives the sheets from the paste coating device and stacks the plural sheet in a bundle in a manner such that the coated first surface of each of the sheets faces downward; and a pressing device which brings a pressing member in contact with a non-coated second surface of an uppermost sheet of the bundle of sheets so as to press the uppermost sheet onto the bundle of sheets;

wherein the binding device is located above the paste coating device and the conveying passage, and the binding device is arranged such that the coated first surface of the sheets faces downward in the binding device.

26. The image forming apparatus of claim 25, further comprising an ejecting port which ejects the bundle of sheets pressed by the pressing device, and a sheet bundle stacking device which stacks a plurality of bundles of sheets ejected through the ejecting port.

27. The image forming apparatus of claim 26, wherein the sheet bundle stacking device comprises a tray section on which the plurality of said bundles of sheets are stacked, a lifting section to shift the tray section upward or downward, and a control section to control the lifting section such that the tray section is shifted downward in accordance with an increase in number of the plurality of bundles of sheets stacked on the tray section.

28. The image forming apparatus of claim 25, further comprising:

a rotating device which is located upstream of the paste coating device with respect to the conveying direction, and which selectively rotates the conveyed sheets by 90 degrees on a plane parallel to the conveying passage.

29. The image forming apparatus of claim 25, further comprising:

a sheet rotation designating section which designates a rotation of the sheet; and a control section which controls the rotating device in accordance with a designation designated by the sheet rotation designating section.

30. The pasting binding apparatus of claim 1, wherein the stacking device comprises a holding member which holds the received sheets such that the coated first surface of the received sheets faces downward, and superposes the received sheets on the bundle of sheets.

31. The image forming apparatus of claim 25, wherein the stacking device comprises a holding member which holds the received sheets such that the coated first surface of the received sheets faces downward, and superposes the received sheets on the bundle of sheets.

32. A pasting binding apparatus for binding a bundle of sheets, comprising:

a paste coating device which coats a line of paste onto a binding side of a sheet being conveyed on a conveying passage in a conveying direction;

a pressing device which is located above the paste coating device, and which stacks the sheet coated with the paste onto a bundle of sheets and presses the sheet onto the bundle of sheets;

a conveying device which conveys the sheet to the paste coating device and to the pressing device; and a rotating device which is located upstream of the paste coating device with respect to the conveying direction and which selectively rotates the sheet by 90 degrees on a plane parallel to the conveying passage in accordance with the binding side of the sheet.

33. An image forming apparatus, comprising:

an image forming unit which forms images on sheets; and a pasting binding unit which changes a binding side of a bundle of the sheets bearing the images formed by the image forming unit, wherein said pasting binding unit comprises:

a paste coating device which coats a line of paste onto a binding side of a sheet being conveyed on a conveying passage in a conveying direction;

a pressing device which is located above the paste coating device, and which stacks the sheet coated with the paste onto a bundle of sheets and presses the sheet onto the bundle of sheets;

a conveying device which conveys the sheet to the paste coating device and to the pressing device; and a rotating device which is located upstream of the paste coating device with respect to the conveying direction and which selectively rotates the sheet by 90 degrees on a plane parallel to the conveying passage in accordance with the binding side of the sheet.

* * * * *